US006460855B2

(12) United States Patent
Shinderovsky

(10) Patent No.: US 6,460,855 B2
(45) Date of Patent: Oct. 8, 2002

(54) ALPHABETIC CHESS PUZZLES AND GAMES

(76) Inventor: Albert Shinderovsky, 2894 W. 8th St., Apartment 20-C, Brooklyn, NY (US) 11224

( * ) Notice: Subject to any disclaimer, the term of this patent is extended or adjusted under 35 U.S.C. 154(b) by 0 days.

(21) Appl. No.: 09/883,224

(22) Filed: Jun. 19, 2001

(65) Prior Publication Data

US 2002/0033576 A1 Mar. 21, 2002

Related U.S. Application Data

(60) Provisional application No. 60/222,726, filed on Aug. 3, 2000.

(51) Int. Cl.[7] ..... A63F 3/00
(52) U.S. Cl. ..... 273/272; 273/260
(58) Field of Search ..... 273/236, 260, 273/261, 272, 275

(56) References Cited

U.S. PATENT DOCUMENTS

| | | | | |
|---|---|---|---|---|
| 1,613,204 A | | 1/1927 | Smith | |
| 2,167,915 A | | 8/1939 | Sweet | |
| 3,851,885 A | | 12/1974 | Pepkowski et al. | |
| 3,923,306 A | | 12/1975 | Cahn-Hidalgo et al. | |
| 4,179,129 A | * | 12/1979 | Loomis | 273/272 |
| 4,188,035 A | | 2/1980 | Metzler, Jr. | |
| 4,201,389 A | | 5/1980 | Vowell | |
| 4,289,314 A | | 9/1981 | Berlino | |
| 4,957,298 A | | 9/1990 | Silverman | |
| 5,018,975 A | | 5/1991 | Todd | |
| 5,098,106 A | | 3/1992 | Hegener | |
| 5,230,515 A | | 7/1993 | Cohen | |
| 5,312,112 A | | 5/1994 | Cohen | |
| 5,556,102 A | | 9/1996 | Huang | |
| 5,558,328 A | | 9/1996 | Krantz | |
| 5,678,001 A | | 10/1997 | Nagel et al. | |
| 5,799,943 A | * | 9/1998 | Morgan | 273/160 |

FOREIGN PATENT DOCUMENTS

| | | |
|---|---|---|
| DE | 2443496 | 5/1975 |
| GB | 1239 | of 1889 |
| GB | 2064966 | 6/1981 |
| GB | 2227674 | 8/1990 |
| GB | 2278551 | 7/1994 |

* cited by examiner

*Primary Examiner*—Benjamin H. Layno
*Assistant Examiner*—Vishu Mendiratta

(57) ABSTRACT

Various embodiments of alphabetic chess puzzles, and methods for forming and solving such puzzles, combine a chessboard and chess piece movement with matrices of letters distributed across the board. A series of embodiments comprise various systems for placing a series of letters upon the board, either in line or separated by other letters and/or board positions. The goal is to find the word(s) and/or expression contained on the board, by moving one or more chess pieces according to the rules of chess to various positions on the board, thereby indicating the letters of the word(s) or expressions. Another embodiment comprises a method for forming chess problems by providing one or more tables of letter hierarchy, forming a word from the letters of the table(s), and positioning opposing chess pieces on the board according to the letter positions in the table(s).

19 Claims, 19 Drawing Sheets

| | a | b | c | d | e | f | g | h |
|---|---|---|---|---|---|---|---|---|
| 8 | | A | S | E | | M | L | Y |
| 7 | | R | | O | N | | T | A |
| 6 | R | O | | T | N | M | R | |
| 5 | R | | C | T | | A | I | N |
| 4 | E | A | | | H | Z | | X |
| 3 | T | | K | A | L | | E | T |
| 2 | R | A | G | E | D | A | R | |
| 1 | | M | K | E | | E | T | B |

100

FIG. 1A

| | a | b | c | d | e | f | g | h |
|---|---|---|---|---|---|---|---|---|
| 8 | B | A | S | E | E | M | L | Y |
| 7 | A | R | S | O | N | A | T | A |
| 6 | R | O | O | T | N | M | R | R |
| 5 | R | M | C | T | | A | I | N |
| 4 | E | A | C | H | H | Z | N | X |
| 3 | T | D | K | A | L | E | E | T |
| 2 | R | A | G | E | D | A | R | K |
| 1 | | M | K | E | | E | T | B |

100

FIG. 1B

| | a | b | c | d | e | f | g | h |
|---|---|---|---|---|---|---|---|---|
| 8 | C | | | S | S | A | | E |
| 7 | O | | R | | B | | | A |
| 6 | | | N | R | G | | | |
| 5 | O | | A | | U | A | N | L |
| 4 | N | E | I | C | A | | E | E |
| 3 | | | | | R | | N | |
| 2 | D | T | M | | U | | M | M |
| 1 | | B | | A | | B | | Y |

FIG. 1C

102

| | a | b | c | d | e | f | g | h |
|---|---|---|---|---|---|---|---|---|
| 8 | B | A | S | E | E | M | L | Y |
| 7 | A | R | S | R | N | A | T | A |
| 6 | R | O | O | T | E | M | R | R |
| 5 | R | V | C | T | H | D | I | N |
| 4 | S | A | C | H | H | Z | N | X |
| 3 | T | K | K | A | L | I | E | T |
| 2 | R | A | Y | E | H | A | R | K |
| 1 | W | O | K | E | C | S | T | B |

206 208 204 210 202

200

FIG. 2A

408

| | | | | | | | | |
|---|---|---|---|---|---|---|---|---|
| 9 | | J | Q | | X | Y | Z | |
| 8 | H | F | M | P | W | N | E | L |
| 7 | N | L | I | V | D | S | G | T |
| 6 | A | B | C | S | O | M | U | B |
| 5 | R | K | F | O | H | Y | C | H |
| 4 | D | E | U | G | R | I | P | A |
| 3 | I | M | V | K | S | E | W | F |
| 2 | T | C | A | U | T | L | D | K |
| 1 | W | P | B | G | N | V | R | O |
| | a | b | c | d | e | f | g | h |

400

FIG. 4F

410

| | | | | | | | | |
|---|---|---|---|---|---|---|---|---|
| 9 | | J | Q | | X | Y | Z | |
| 1 | K | D | R | V | C | G | B | O |
| 2 | F | W | O | L | T | U | A | W |
| 3 | A | P | I | E | S | K | P | S |
| 4 | H | O | A | F | H | V | M | I |
| 5 | B | U | M | R | L | U | E | D |
| 6 | T | G | H | N | C | T | K | R |
| 7 | L | S | D | V | I | G | C | N |
| 8 | E | N | W | P | M | F | B | Y |
| | h | g | f | e | d | c | b | a |

402

FIG. 4G

412

| | | | | | | | | |
|---|---|---|---|---|---|---|---|---|
| 9 | K | J | Q | V | X | Y | Z | N |
| 8 | H | F | M | P | W | P | E | L |
| 7 | P | L | I | C | D | S | G | T |
| 6 | A | B | C | S | O | M | U | B |
| 5 | R | S | F | O | H | Y | C | H |
| 4 | D | E | U | G | R | I | P | A |
| 3 | I | M | C | S | S | E | W | F |
| 2 | T | C | A | U | T | L | D | S |
| 1 | W | P | B | G | P | C | R | O |
| | a | b | c | d | e | f | g | h |

404

FIG. 4H

414

| 9 | K | J | Q | V | X | Y | Z | N |
|---|---|---|---|---|---|---|---|---|
| 1 | S | D | R | C | C | G | B | O |
| 2 | F | W | O | L | T | U | A | W |
| 3 | A | P | I | E | S | S | P | S |
| 4 | H | C | A | H | F | C | M | I |
| 5 | B | U | M | R | L | U | E | D |
| 6 | L | G | O | P | C | T | S | R |
| 7 | T | S | D | C | I | G | B | P |
| 8 | E | P | W | P | M | F | H | Y |
| | h | g | f | e | d | c | b | a |

406

FIG. 41

ALPHABETIC CHESS PUZZLES AND GAMES

CROSS-REFERENCE TO RELATED APPLICATION

This application claims the benefit of U.S. Provisional Patent Application Serial No. 60/222,726, filed Aug. 3, 2000.

BACKGROUND OF THE INVENTION

1. Field of the Invention

The present invention relates generally to puzzles, board games, and related pastimes, and more specifically to various methods for forming and solving word puzzles formed on an eight by eight position matrix of sixty four positions, as on a chess board. The present inventive system may also be used as a means for forming chess positions or problems on a chess board, as well.

2. Description of the Related Art

The game of chess has been known in numerous cultures for centuries, and its basic rules have been well established for most of that period. Chess has proven to be a most popular board game due to the relative simplicity of the rules, yet practically innumerable permutations and combinations of possible moves. Different types of word puzzles and games have also evolved in many different languages, such as the well known crossword puzzle and other similar puzzles and games.

Heretofore, it has been conventionally thought that the two above types of puzzles or games had little or nothing in common with one another, other than their use as a pastime or recreational activity. Chess does not make use of any alphabetic system (other than as a means of linguistically describing the game and/or any positions on the board), and while certain word puzzles are placed upon a matrix or grid of positions in which individual letters are placed to form words, such word puzzles have never been related to the game of chess, other than perhaps utilizing certain chess terms as clue words in the puzzle or game.

The present inventor has developed systems and methods which combine elements of word puzzles and games with the game of chess, to form new types of games and methods of forming word puzzle and chess position layouts. The novel game and puzzle methods of the present invention provide additional challenges desired by fans and enthusiasts of the game of chess and word puzzles, as well as providing means for forming various chess problems and positions by using letter and word positions on a chessboard and using they conventional moves of chess to determine solutions to word problems. The present invention can provide a refreshing change of pace for chess and word game enthusiasts, as well as serving as an instructional tool for teaching spelling and other linguistics skills along with the game of chess.

A discussion of the related art of which the present inventor is aware, and its differences and distinctions from the present invention, is provided below.

U.S. Pat. No. 1,613,204 issued on Jan. 4, 1927 to Ernest W. Smith, titled "Game Device," describes a kit for forming and solving crossword puzzles. The Smith device comprises a nine by nine matrix of eighty one positions or receptacles in a board. A series of letter cubes is provided for removable placement within the receptacles of the board, with the letter cubes having a different letter or a blank area on each face. The cubes are placed in the receptacles with the blank faces upwards to form the puzzle grid, and the puzzle is solved by placing additional cubes in the remaining receptacles with the proper letter of each cube facing upwardly. Smith does not teach any means of forming or solving a word puzzle using the moves of chess pieces on a chessboard, and in fact teaches away from a chess type game due to the eighty one position board used for his word puzzle apparatus.

U.S. Pat. No. 2,167,915 issued on Aug. 1, 1939 to Donald H. Sweet, titled "Game," describes a word forming game played on a board having a nine by seven matrix of positions. Each player is provided with a set of the twenty six letters of the English alphabet, arranged on opposite ends of the board. The object is to form words with one's own set of letters, whereupon corresponding letters of the opponent's set may be removed from the board. The first player to remove all vowels from the opponent's set, wins the game. Sweet describes the movement of the pieces as resembling the queen in chess, but no other moves are provided. Also, Sweet teaches away from the use of a chessboard configuration, stating that such a board layout does not work well with his game.

U.S. Pat. No. 3,851,885 issued on Dec. 3, 1974 to Michael Paul Pepkowski et al., titled "Chess Game Device," describes a chess "travel set," including sequential descriptions of chess moves according to previously played "classic" games. As single player uses the Pepkowski et al. chess set to play a single handed game, sequentially uncovering the prerecorded moves and responding with a move as the player feels appropriate. The Pepkowski et al. device is directed to pure chess, rather than combining the game of chess with alphabetic or any other elements, as provided by the present alphabetic chess game.

U.S. Pat. No. 3,923,306 issued on Dec. 2, 1975 to Gerardo R. A. Cahn-Hidalgo et al., titled "Educational Game Playing Device," describes a relatively complex physical structure having electric illumination backlighting any one of several board layouts which may be used. A punched data card is placed within the device, beneath the board. The card causes various positions to be illuminated on the board, thereby providing exemplary moves for an opponent to which the player may respond. The Cahn-Hidalgo et al. device is thus more closely related to the solo chess game device of Pepkowski et al., discussed immediately above, than to the present alphabetic chess puzzles invention. Cahn-Hidalgo et al. do not provide any means of forming or solving word puzzles laid out on a chess board, as provided by the present invention. Moreover, the present alphabetic chess puzzles invention also provides a means of forming chess problems, which means is not provided by Cahn-Hidalgo et al.

U.S. Pat. No. 4,188,035 issued on Feb. 12, 1980 to Robert A. Metzler Jr. et al., titled "Chess Word Game," describes a game in which at least the major pieces of each side are provided with removable letters of the alphabet. Players select an eight letter word, and form the word across the board by moving the chess pieces according to the standard rules of chess. However, Metzler et al. do not provide any means of solving a word problem which has been previously applied to the positions of the board, as provided by at least one embodiment of the present invention. Moreover, Metzler et al. do not provide any letter tables for applying to a chess board and forming chess problems therefrom, which aspect is another embodiment of the present invention. Essentially, the Metzler et al. game differs fundamentally from the present invention, in that Metzler et al. do not provide for the application of letters of the alphabet to the chess board itself, but only removably to the chess pieces played on the board. In contrast, the present invention applies a series of letters to the board, but uses standard chess pieces devoid of additional lettering or marking in forming and solving the puzzles formed.

U.S. Pat. No. 4,201,389 issued on May 6, 1980 to David H. Vowell, titled "Word Game," describes a game having a board with mechanical means for setting any of a number of letters in each of the multiple positions of the board. The game is similar to the well known game of "Scrabble" (tm), but no inclusion or combination with any aspects of the game of chess is provided by Vowell in his game. Also, Vowell arranges the letters of his game according to their frequency of appearance in the English language. One embodiment of the present game also utilizes a table of letters based upon frequency of use, which tables are disclosed herein. However, the tables used with the present game are based upon the frequency of appearance of the initial letter of words appearing in a standard English dictionary, which is a different matter from the frequency of use of all letters throughout all words.

U.S. Pat. No. 4,289,314 issued on Sep. 15, 1981 to Gary M. Berlino, titled "Word Forming Checkers Game Method," describes a game using a series of lettered dice, each having a plurality of different letters of the alphabet thereon. The dice are arranged on a board having an eight by ten matrix of positions and moved according to the standard rules of the game of checkers. The two players may manipulate the cubes to display any letter thereon as the cubes are moved, and attempt to form words along diagonal paths on the board. The Berlino game method differs substantially from the present invention, in that (a) Berlino teaches a competitive game, whereas the present invention comprises various word puzzles formed using chess rules, or chess puzzles formed using letters of the alphabet, on a chess board, to be solved by a single person; (b) Berlino requires a non-standard board, while the present puzzle methods utilize a board having a conventional eight by eight matrix of positions; and (c) the playing pieces of Berlino are lettered, while the board is not, while the board of the present invention includes letters, and the chess pieces are not lettered.

U.S. Pat. No. 4,957,298 issued on Sep. 18, 1990 to Jack Silverman, titled "Permutation Group Games, " describes a complex game involving various mathematical operations using a table of letters of the alphabet. Letters are defined by row and column to arrive at words formed therefrom, using various operations to determine the rows, columns, and letters. Silverman does not provide any form of board for his game, but only a table having a twenty six by twenty six matrix of letters of the alphabet. Moreover, Silverman does not utilize any game pieces or their moves (chess or otherwise) in the method of play of his game, nor does he provide any means of forming chess problems or word problems which may be solved using chess moves on a board, as provided by the present alphabetic chess puzzles methods.

U.S. Pat. No. 5,018,975 issued on May 28, 1991 to Alan B. Todd, titled "Educational Amusement Device Which Includes A Game Card, And Method For Using The Game Card," describes a crossword puzzle type game, wherein one or more starter words are filled in. The object is to look through the advertisements of a publication (or view or listen to such on television or radio), and fill in the blank areas using words found in such advertising. Points are provided, depending upon the length of the words and crosswords found. The Todd game system does not utilize any form of board or movable pieces thereon, nor does it utilize any rules of movement for any such game, e. g., chess, as provided by the present inventive methods. Moreover, Todd does not provide any means of forming a puzzle or problem, as provided by the present invention.

U.S. Pat. No. 5,098,106 issued on Mar. 24, 1992 to Manfred Hegener, titled "Chess Teaching Computer, describes a computerized chessboard providing for play of the game against the computer, and also including computerized memory with a series of chess problems stored therein. A player may play a game against the computer, or may test his/her skills against previously devised chess problems stored in the device. However, the Hegener computerized apparatus, is directed only to the game of chess; it does not include any alphabetic systems or problems whatsoever, as provided by the present alphabetic chess puzzles invention. Moreover, one embodiment of the present invention describes means for forming chess problems, whereas the Hegener computer already has such problems stored therein when provided to the player or user.

U.S. Pat. No. 5,230,515 issued on Jul. 27, 1993 to Gene D. Cohen, titled "Word Forming Board Game Including Elements Of conflict," describes a game having a thirteen by thirteen matrix of playing positions thereon. All of the letters of the Roman alphabet are placed on the various board positions, in a symmetrical pattern so they may be viewed in the same order from either side of the board. Cohen provides a series of playing pieces for each player, each having different rules of movement. While some of the pieces are allowed to move in patterns identical to certain chess pieces, other pieces in the Cohen game move differently. The object of the Cohen game is to form words by moving the pieces to various letters on the board, with each player attempting to do so and also attempting to block the formation of words by the opposing player. The Cohen game differs from the present alphabetic chess puzzles invention, in that (a) it is a competitive game to be played by two persons or teams, rather than a solo effort by a single player to develop or solve a puzzle, as provided by the present invention; (b) Cohen uses a much larger board than a standard eight by eight chessboard, and provides playing pieces and rules which differ from chess, whereas the present invention uses a conventional chessboard layout and chess pieces; and (c) Cohen does not provide any means for forming word puzzles or chess problems, or for solving those puzzles or problems, as provided by the present invention.

U.S. Pat. No. 5,312,112 issued on May 17, 1994 to Gene D. Cohen, titled "Word Forming Board Game Including Elements Of Conflict," is a division of the '515 U.S. Patent to the same inventor, discussed immediately above. The same points of distinction noted above between the '515 U.S. Patent and they present invention, are seen to apply here as well.

U.S. Pat. No. 5,556,102 issued on Sep. 17, 1996 to Pingsheng Huang, titled "Apparatus And Method Of Playing A Word Composition Game Where Compass Direction Assigned To Each Player And The Time When The Game Is Played Affects Game Play," describes a game somewhat resembling Scrabble (tm), in that a series of lettered blocks are provided to the players to form words. Additional restrictions are applied relating to directional orientation of the players and the time period, but Hüang does not disclose the use of any playing pieces having certain physical moves on a game board, as provided in the game of chess and which rules are incorporated in the present invention. Moreover, the lettered blocks or tiles of the Huang game are dealt to the players at various times during the course of the game, rather than being provided in a predetermined tabular form or in a predetermined layout on a game board, as provided in the present invention. It is also noted that the Huang game is a competitive endeavor among four players, whereas the present invention is more closely related to the forming and solving of puzzles and problems by a single participant.

U.S. Pat. No. 5,558,328 issued on Sep. 24, 1996 to Tomas Krantz, titled "Relative Frequency-Based Word Game," describes a dice game, with several sets of dice each having a plurality of letters thereon. No game board is provided by Krantz; the dice are merely tossed on a suitable surface by each player ink turn, with players noting any words which may be formed from the resulting face up letters on the dice. Krantz does not incorporate any form of game using a game board and playing pieces movable on such a board, in his dice game.

U.S. Pat. No. 5,678,001 issued on Oct. 14, 1997 to Ralph Nagel et al., titled "Computerized Game Teaching Method," describes a computerized solo game much like the chess teaching computer of the Hegener '106 U.S. Patent discussed further above. As in the Hegener computer, Nagel et al. do not provide any word forming means or letters of the alphabet with their device; rather, it is purely for teaching chess, and solutions to chess problems.

British Patent Publication No. 1,239 accepted on Dec. 14, 1889 to Emil A. Wuterich, titled "A New Game Of Skill, Together With The Appliances For Playing It," describes a competitive game resembling chess, with the playing pieces comprising the letters of the alphabet. The board is nine positions wide, with extensions at top and bottom to provide room for all twenty six letters of the Roman alphabet on each side. Vowels are empowered with moves resembling the higher level pieces in chess, with consonants having more restricted moves. The object is to form a word across the opponent's board extension, or to capture the "U" vowel of the opponent. Wuterich does not provide any tabular form of letter hierarchy for developing chess problems with his game, nor does he provide for the solving of word problems or puzzles. Rather, the Wuterich game is a competitive activity more closely resembling the game disclosed in the '915 U.S. Patent to Sweet, discussed further above, than the present alphabetic chess puzzles invention.

German Patent Publication No. 2,443,496 published on May 22, 1975 to Iwaya Corp. illustrates an automated and electrified chess board assembly, more closely resembling the computerized devices of the Hegener '106 and Nagel '001 U.S. Patents than the present invention. The '496 German Publication does not appear to include any alphabetized play for forming words, nor any means for forming chess problems using the letters of the alphabet on a chess board or forming or solving word problems using the conventional moves of chess pieces on a board, as provided by the present invention.

British Patent Publication No. 2,064,966 published on Jun. 24, 1981 to Leslie P. Collard et al., titled "Board Game Teaching Aid," describes a chess and checkers teaching aid comprising board diagrams or positions of problems, and descriptions of the solutions for the problems. The Collard et al. disclosure is directed purely to the teaching of the play of chess and checkers, and as such does not include any variations on these conventional games, whereas the present invention comprises various embodiments incorporating the letters of the alphabet for forming word puzzles and problems and for forming chess problems based upon the positioning of the letters of a word placed upon the board.

British Patent Publication No. 2,227,674 published on Aug. 8, 1990 to Christopher J. Cunningham, titled "Word Game," describes a game using a board resembling a conventional chess or checker board (but slightly larger), wherein two opposing players each have a set of four lettered playing pieces. Each letter of each set is different, and is restricted to different patterns of permissible moves. The object of the game is to move the playing pieces across the board in accordance with the rules, to reform the initial word formed by the letters in their starting positions. As such, the Cunningham game is more closely related to the games described in the '035 and '314 U.S. Patents respectively to Metzler and Berlino and particularly the 1,239 British Patent Publication to Wuterich, each of which has been described further above, than to the present alphabetic chess puzzle methods invention.

Finally, British Patent Publication No. 2,278,551 published on Dec. 7, 1994 to James G. Knowles, titled "Selectable Points Puzzle," describes a board having an eight by eight matrix of positions thereon, with a single playing piece or "selector." The selector is only permitted to move in accordance with the movement permitted of a knight in chess, i. e., three positions, with the last one or two being at right angles to the first leg of the movement. The object of the Knowles game is to move the selector to as many different positions on the board as possible without repeating a position, akin to the chess exercise known as the "knight's tour." Knowles does not include any alphabetic system with his game for creating or solving word or chess problems, as provided with the present invention, and provides only a single playing piece and correspondingly restricted movement.

None of the above inventions and patents, taken either singly or in combination, is seen to describe the instant invention as claimed.

SUMMARY OF THE INVENTION

The present invention comprises a series of alphabetic chess puzzles and problems, and methods for forming and solving such puzzles and problems. In a first embodiment, a series of words are developed for placement upon an eight by eight board in any orientation, i. e., horizontally, vertically or diagonally left, right, up, and/or down. A single chess piece and starting position for the piece on the board are determined, and the words are applied to the board. Certain key letters are removed from the board, with the solver of the puzzle being required to move the chess piece to the blank positions of the board and determine the appropriate letter for placement at that position to form a word, or partial word. Additional penalty or "pit" positions may be provided on the board, to add further challenge to the solver of the puzzle.

In a second embodiment, a word having a given number of letters therein, and a series of chess pieces equal to the number of letters in the word, are selected. The chess pieces are arranged on the board so that each piece may be moved a predetermined number of times (e. g., one move each) to form a single horizontal, vertical, or diagonal line. The word comprising the puzzle is placed along this line representing the final positions of the chess pieces, with additional letters and/or words being placed upon the board to conceal the solution to the puzzle. The solver of the puzzle must then move each chess pieces appropriately to form a single line, to find the word which has been placed upon that line.

The third embodiment is related to the second embodiment, in that a single word or phrase is selected to be uncovered by a series of consecutive moves by a single chess piece. The starting position of the piece is determined, and the letters forming the word or phrase are placed along the predetermined route of the chess piece over the board. The movement pattern may be taken from the moves of a single piece in a classic game played between two masters in a tournament, or otherwise selected. Additional letters are placed upon the board to conceal or camouflage the word or phrase to be discovered. The puzzle is solved by moving the chess piece in accordance with the designated moves, as provided to the person solving the puzzle.

Finally, a fourth embodiment comprises the formation of a chess problem incorporating a series of opposing chess pieces. A word is selected, with the letters of the word being placed upon a chessboard in accordance with one or more tables of the letters of the Roman (or other) alphabet. Tables may be provided for each side, and/or may have different arrangements of letters. The tables are organized according to the frequency of the letters as they appear as the first letter of words used in the English language, and thus differ from other tables which are based upon the overall frequency of occurrence of letters. The chess pieces are selected and placed upon the board at the locations of the letters, to form a chess problem for solution (e. g., "white to move and win," etc.). The above described means for forming and solving various word problems using classical chess movement rules, and means for forming chess problems using letter tables and words to define the initial positions of the chess pieces on the board, provide a novel means of creating and solving such problems and puzzles.

Accordingly, it is a principal object of the invention to provide improved puzzles combining alphabetic systems and rules with the rules and movement of conventional chess.

It is another object of the invention to provide an improved alphabetic chess puzzle having a series of words or a phrase on a chessboard, with the solution to the puzzle comprising the movement of a single chess piece over the board from a predetermined starting position to discover the words disposed upon the board.

It is a further object of the invention to provide an improved alphabetic chess puzzle having a single word or phrase in a single line and a series of chess pieces equal to the number of letters of the word or phrase on a chessboard, with the solution to the puzzle comprising moving each of the chess pieces a predetermined number of moves to form a straight line along the predetermined word.

An additional object of the invention is to provide an improved alphabetic chess puzzle having a single word or phrase and a single chess piece provided on a chessboard, with the solution to the puzzle comprising moving the single piece in a series of moves along a predetermined route to uncover the word or phrase placed along that route.

Still another object of the invention is to provide an improved method of devising a chess problem, comprising selecting a word, placing letters from the word on a chessboard in accordance with one or more tables of letter hierarchy, and selecting and placing a series of chess pieces upon the positions of those letters.

These and other objects of the present invention will become readily apparent upon further review of the following specification and drawings.

BRIEF DESCRIPTION OF THE DRAWINGS

FIG. 1A is an example of the initial layout of a game board having a word puzzle thereon in accordance with the first embodiment of the present invention, for solution using the moves of a knight chess piece.

FIG. 1B shows the game board of FIG. 1A with the solved word puzzle thereon.

FIG. 1C is a second example of a game board having a word puzzle thereon, for solution using the moves of a queen or king chess piece.

FIG. 2A is a game board having a word puzzle thereon according to the second embodiment of the present invention, and showing the multiple moves of a single chess piece to solve the problem.

FIG. 4F is a first table of letter hierarchy used in the determination of letter location for the letters of FIG. 4A.

FIG. 4G is a second table of letter hierarchy used in the determination of letter location for the letters of FIG. 4C.

FIG. 4H is a variation of the table of letter hierarchy of FIG. 4F.

FIG. 4I is a variation of the table of letter hierarchy of FIG. 4G.

Similar reference characters denote corresponding features consistently throughout the attached drawings.

DETAILED DESCRIPTION OF THE PREFERRED EMBODIMENTS

The present invention comprises various embodiments of methods for forming and solving alphabetic chess puzzles and for forming chess problems on a board using an alphabetic system for positioning the pieces. FIGS. 1A through 1E illustrate the steps and procedures involved in the first embodiment of the present invention, wherein a series of words or one or more phrases is placed upon a board 100 comprising an eight by eight matrix of positions, in the manner of a conventional chess board. Conventional chess notation is used throughout the present disclosure to identify each position of the rows and columns of the board 100 (and other boards), with the rows being numbered from a lowermost row 1 to an uppermost row 8 and the columns being lettered from a leftmost column a to a rightmost column h. Thus, the lower left position of the board 100 is designated as position a1, while the upper right corner position of the board 10 is designated as position h8, etc.

Figure 1D:
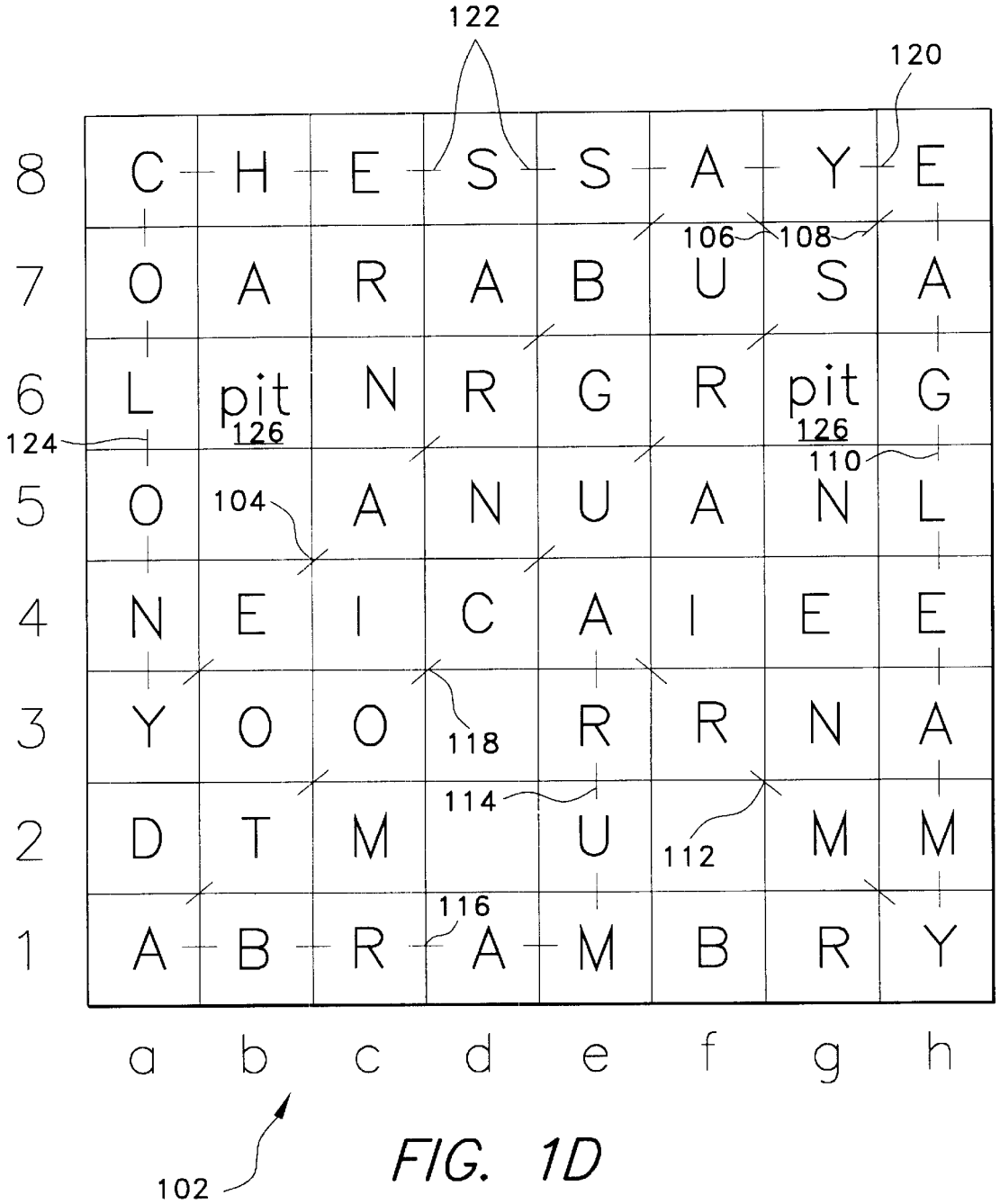
FIG. 1D shows the solved word puzzle of the board of FIG. 1C.
Figure 1E:
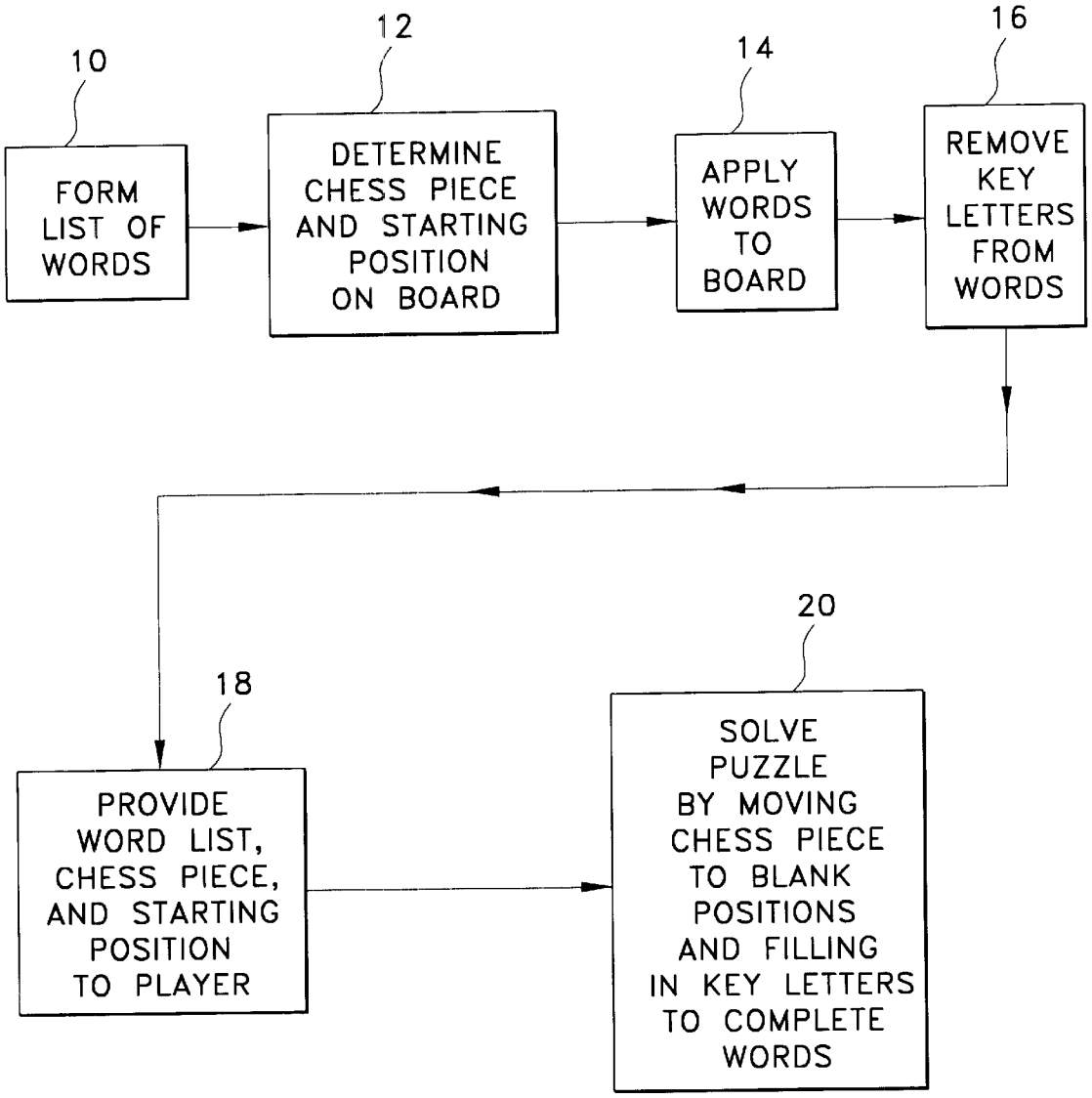
FIG. 1E is a flow chart describing the general procedure for forming and solving the word puzzles of FIGS. 1A through 1D.

A list of words or phrases is initially developed for placement on the board 100, generally as indicated by the first step of FIG. 1E. These words or phrase(s) are applied to the board 100 in any desired arrangement, so long as the consecutive letters of the words or phrase(s) are located on board positions which are reached by a chess piece moving sequentially on the board 100. For example, a puzzle to be solved using a rook, which moves only horizontally and vertically on the board, would not have consecutive letters of a word or phrase arranged diagonally.

Before the words or phrase(s) are applied to the board 100, the specific chess piece to be used for solving the puzzle must be selected, generally as indicated by the second step 12 of FIG. 1E. Preferably, any of the higher ranking pieces may be used, i.e., any chess piece other than the pawn, which movement is too restrictive and does not allow reverse or lateral movement. The preferred chess pieces to be used in solving the puzzles of the present invention comprise the king, queen, rook, bishop and knight, and use their conventional chess movement patterns.

The initial or starting position for that piece on the board 100 must also be determined. At that point, the person setting up the puzzle may place the words or phrase(s) on the board 100 as indicated generally by the third step 14 of FIG. 1E, with the first letter of the first word or phrase being located at the terminating position for the first move for the chess piece, the second letter at the terminating position for the second move, etc.

Even when additional letters are placed upon the board 100 to conceal or "camouflage" the object words or phrase (s), the astute player or puzzle solver may still be able to detect the object word or phrase(s), particularly when the puzzle is to be solved using a chess piece which moves in a straight line, e. g., rook, queen, or even a bishop with its diagonal movement. Accordingly, certain key letters along the path of travel of the chess piece are removed from the board 100 to provide a series of blank positions, e. g., positions 1*a,* 1*e,* 2*h,* 3*b,* etc., as shown in FIG. 1A and indicated by the fourth step 16 of FIG. 1E.

In the example of FIG. 1A through 1E, the selected chess piece is the knight, which according to classic chess rules, moves a total of three positions on each move, with the last one or two positions being at right angles to the first leg of the move. The initial position for the knight is on position e5. These conditions, along with the board layout of FIG. 1A, are provided to the player or person attempting to solve the puzzle, as indicated by the fifth step 18 of FIG. 1E. Also, a list of the object words to be found in the puzzle is also preferably provided to the player, although this may not be essential with more advanced players. A list of the object words used in forming the puzzle of FIG. 1A, and shown in the completed puzzle of FIG. 1B, is shown in the following table:

TABLE I

| OBJECT WORD LIST FOR THE PUZZLE OF FIGS. 1A AND 1B | | | | |
|---|---|---|---|---|
| amaze | cadet | mama | rose | trine |
| aroma | dark | madam | seemly | yak |
| arson | each | mix | sonata | yarn |

TABLE I-continued

| OBJECT WORD LIST FOR THE PUZZLE OF FIGS. 1A AND 1B | | | |
|---|---|---|---|
| barret | earn | raker | sonant |
| base | edge | retry | tact |
| brother | kale | root | taker |

At this point, the player attempts to solve the puzzle, generally as noted by the sixth step of FIG. 1E. It will bet noted that the knight placed upon position ehas a choice of five different possible moves to one of the blank positions f7, g4, f3, c4, or c6. Thus, it is up to the person solving the puzzle, to consider the route of the playing piece in order to assure that the piece may continue to be advanced sequentially and consecutively along the desired route, to continue to discover positions where applicable letters to the object words are located.

In the above example, an initial move to position f7 permits a letter to be filled in at that position. Examination of row 7 reveals that the placement of an A at position a7 and an S at position, along with the placement of an A at the first move position F7, results in the overlapping words "ARSON" and "SONATA" being formed across row 7. It will also be seen that a knight may advance to these positions by sequential moves from the starting position e5, to positions c6, a7, b5, and c7, with another move possible to position e8. However, the path stops at this point, ask the knight has no more possible moves remaining from position e8 to another blank position, as required to continue to solve the puzzle. Thus, the puzzle solver may look at alternative routes in an attempt to fill in as many blanks as possible on the lower portion of the board 100.

A good choice for a travel route which will fill in a large number of the blank spaces, is f7 (to fill in an A), h6 (an R), g4 v(N), h2 (K), f3 (E), d4 (H), b(M), c7 (S), and finally, a8 (B). The result of such a route with the knight starting on position e5 is shown on the completed board 100 of FIG. 1B. This route leaves only four unfilled positions in addition to the starting position e5, i. e., positions a1, e1, c6, and a7. While it would be desirable to fill in those blank positions as well, the present puzzle may provide alternative routes, as described above, with none of the routes providing a complete solution for the puzzle. Thus, the solver of the puzzle must select the initial move or moves carefully, in order to reach as many positions as possible.

FIGS. 1C and 1D illustrate another example of the alphabetic chess puzzle embodiment of FIGS. 1A through 1E. In the example of FIGS. 1C and 1D, a queen, which may move any number of positions either horizontally, vertically, or diagonally, is used as the chess piece, with the starting position at a3. The object words for this puzzle are listed below, in Table II:

TABLE II

| OBJECT WORD LIST FOR THE PUZZLE OF FIGS. 1C AND 1D | | | | |
|---|---|---|---|---|
| abram | arum | chess | eagle | lee |
| ambry | atcc | colony | essay | noma |
| arab | aura | curse | gleamy | ruin |
| arba | aurel | doing | guy | year |
| army | canna | | | |

In addition to the above words (or others, depending upon the letters used to form the puzzle and the chess piece used to solve the puzzle, etc.), a series of simpler two letter words ("at," "he," "on," "to," etc.) may be used as connectors between longer words, where a chess piece is used which is capable of moves of variable magnitude or length, i. e., queen, rook, and bishop.

As in the example of FIG. 1A, at least one letter of each object word used to form the puzzle is removed from the board 102, to form the incomplete puzzle shown in FIG. 1C. The queen is placed on the given starting position a3, and the player or solver of the puzzle is given the list of object words (and any two letter words) which were used to form the puzzle. The object remains the same as in the example of FIGS. 1A and 1B, with the player moving the chess piece along the paths or routes required to form the words provided on the object word list, along with any two letter connector words which might be used.

The player may move the queen in any vertical direction, or any diagonal or horizontal direction toward the right on the board 102, from the initial position a3 of the board 102. However, most such moves do not result in forming any of the object words. It al will be seen that only two moves are possible: (1) directly upward from the starting position a3 to the upper left position a8, filling in the starting position a3 with a "Y" and position a6 with an "L," to form the word "COLONY"; or (2) diagonally upward from the starting position a3, filling in the blank positions at a3 and c5 respectively with the letters "Y" and "A" to form the word "YEAR," and continuing to position f8 to complete the word "ARBA," which uses the last two letters of the word "YEAR" on the same diagonal. The various moves are indicated by the dashed lines between positions on the board 102, with the first move indicated by the reference numeral 104, the second by the numeral 106, etc.

From position f8, the player must use a pair of two letter connector words to reach the upper right position h8, in order to continue downwardly along the right column to form the words "EAGLE" and "GLEAMY" therein. If the player moves from position f8 diagonally downwardly and to the right one position to g7, the two letter word "AS" may be formed, as indicated by the second move 106. Another diagonal move 108 upwardly and to the right to position h8 results in the letters "SE," the chemical symbol for selenium. This positions the queen at position h8, from which the queen may move downwardly to h1 as shown by move 110, forming the words "EAGLE" and "GLEAMY," as noted above.

The queen is then moved diagonally upwardly and to the left to position e4, as indicated by the fifth move 112, placing an "R" at position f3 to form the word "ARMY." (The letters forming a given word may either be in proper or reverse order, according to the rules of the present puzzle embodiment.) The sixth move 114 takes the queen downwardly from position e4 to position e1, with an "M" being added at position e1 to complete the word "ARUM" from positions e4 to e1. Movement is continued from e1 leftward to a1 on the seventh move 116, filling in positions c1 and a1 respectively with an "R" and an "All to form the word " ABRAM" from a1 to e1, and thence diagonally upwardly and to the right from a1 completely across the board 102 to the upper right position h8 as indicated by the eighth move 118, forming the words "ATOC" and "CURSE" by filling in the letters at positions c3 and f6.

At this point, the only permissible move is along the upper row a8-f8, as repetition of moves is not permitted, and the rightmost column h8-h1 has already been completed. However, by moving directly to the left one position to position g8 on the ninth move 120, the letter "Y" may be placed at position g8, forming the archaic definite article "YE." This does not repeat any previous moves, as the two letter word paths traveling from position f8 to g7, and thence to h8, avoided position g8, and it is permissible to cross previously traveled paths. Movement continues across the upper row to position a8, forming the words "CHESS" and "ESSAY" on the tenth move 122, thence downwardly from a8 to the initial position a3 on the final move 124, forming the word "COLONY."

It will be noted that the above described route results in the formation of only twelve of the twenty two object words provided in the list of Table II. Various alternative routes or paths could beg taken in an attempt to form additional words. However, each of those alternative paths has some flaw which results in fewer words being formed. For example, The alternative path straight upwardly from the starting position a3, thence to a8 and across to position h8, forms the words "CHESS" and "ESSAY" along the topmost row a8-h8. However, continuing from the lower right position h8 along the path described above, eventually results in reaching the upper right position h8 of the board 102 again. As the route of movement of the chess piece has already taken it along the uppermost row a8-h8 and rightmost column h8-h1, any movement from this points would repeat at least a portion of a previously traveled route, which is not permissible according to the rules. Thus, the queen would be "trapped" at position h8, and would not be able to form the words "YEAR," "ARBA," and "COLONY," as formed by using the first described route.

In a similar manner, the queen could move straight to the left along the lowermost row h1-a1 to form the words "AMBRY" and "ABRAM," bypassing the diagonal move from h1 to e4 and the formation of the words "ARMY" and "ARUM." However, as the word "ABRAM" is formed on either route, the alternative route avoiding. the diagonal results in the formation of one less word. Another alternative is to continue diagonally to the upper left after completing the word "ARMY" at position e4 to the upper left position a8, forming the diagonal word "CANNA." However, this results in the loss of the two diagonal words "ATOC" and "CURSE" from positions a1 to h8, as there is no way to arrive at one of the beginning or end points of these words without repeating a portion of a previously traveled path.

The person forming the above described puzzle may add further challenges to the solver, if so desired. An example of such are the two hindrance positions or "pits" 126 shown in the completed puzzle of FIG. 1D. These hindrance positions 126 serve as "path blockers," prohibiting movement of a chess piece thereacross, or in the case of the knight, prohibiting termination of a move thereon. Encounter with such a "pit" 126, results in at least the loss of that move and a requirement that the piece be moved back to the preceding position where an alternate path may be selected, or perhaps back to the starting position for another attempt.

Figure 2B:
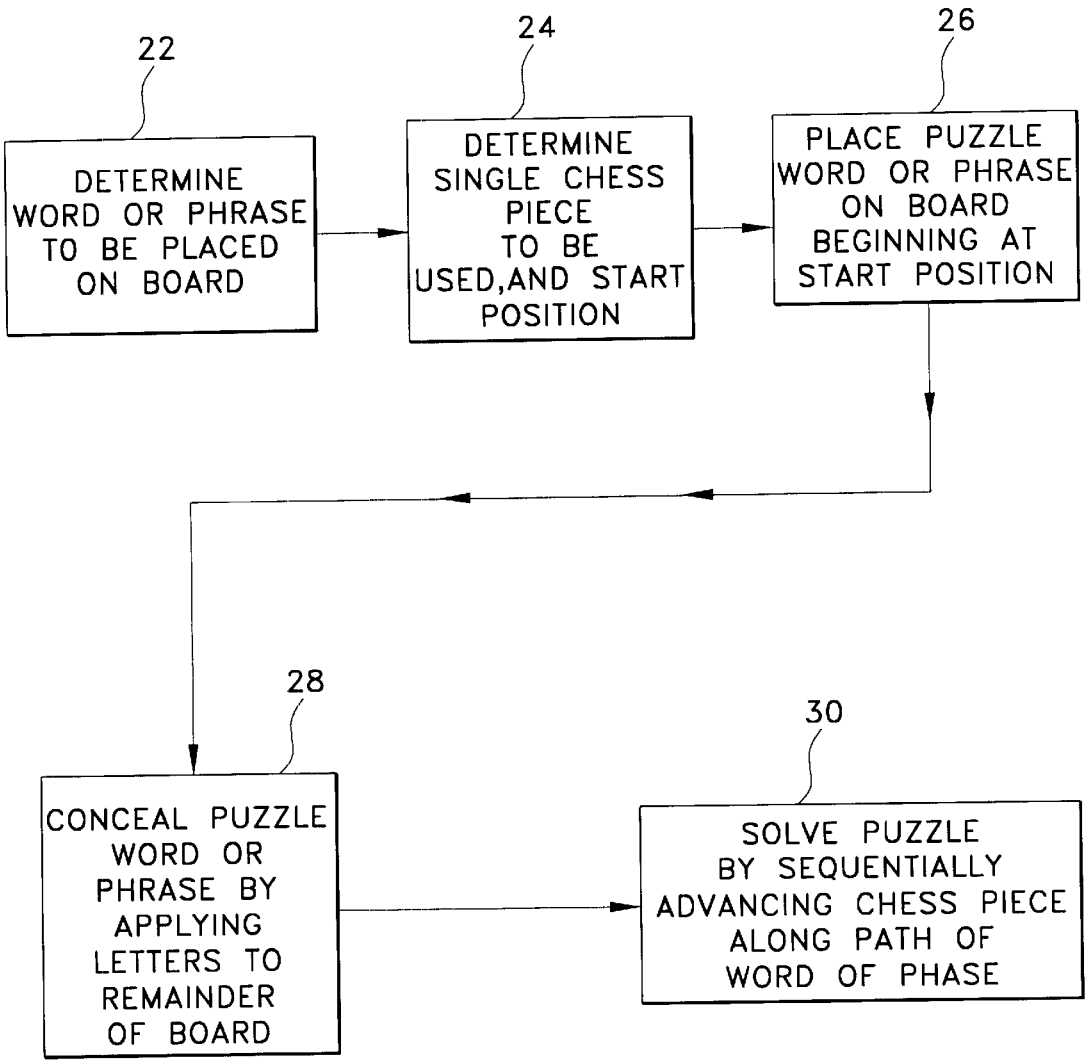
FIG. 2B is a flow chart describing the general procedure for forming and solving the word puzzle of FIG. 2A.

A related embodiment to the puzzles of FIGS. 1A through 1D is illustrated and generally described in FIGS. 2A and 2B. In the embodiment of FIGS. 2A and 2B, only a single word or phrase is placed upon the chess board 200. This word or phrase may be placed upon any portion of any row, column, or diagonal as desired and preferably changes direction one or more times along its path over the board 200. Preferably, the route of the word duplicates the sequential movement of a chess piece over the course of several moves of an actual chess game. The object of the puzzle of FIG. 2A is to move the subject chess piece over the route of that piece which was played in the actual game, thereby uncovering the word.

The formation of the puzzle of FIG. 2A is accomplished in a manner similar to that of forming the puzzles of the first embodiment of FIGS. 1A and 1C. First, the word or phrase to be placed on the board 200 is selected, as indicated generally by the first step 22 of FIG. 2B. This word or phrase may be selected to have a number of letters equal to the number of positions over which a chess piece is moved as recorded from an actual game of chess, if so desired, or alternatively the type and movement of the chess piece may be selected to agree with a predetermined phrase. Once the chess piece and its starting position have been determined, as indicated by the second step 24 of FIG. 2B, the selected word or phrase is placed upon the board 200 with its first letter at the location of the starting position for the chess piece, generally as indicated by the third step 26 of FIG. 2B. The predetermined word to be found by the puzzle solver is preferably concealed by applying letters to each of the remaining positions of the board 200, as indicated by the fourth step 28 of FIG. 2B, to form the finalized puzzle exemplified in FIG. 2A.

The player or solver of the puzzle is provided with the completed board 200 as shown in FIG. 2A (with the exception of the marked path of travel of the chess piece), with the type of chess piece used, its starting position on the board, and perhaps one other piece of information, such as the word or phrase to be uncovered or the movement of the chess piece. In the case of the puzzle illustrated on the board 200 of FIG. 2A, the surname of the present inventor ("SHINDEROVSKY") has been placed on the board.

The puzzle is solved by placing the appropriate chess piece (as defined for the puzzle solver) on the starting position of the puzzle, also defined for the solver and sequentially advancing the piece along the path of the word or phrase, as indicated generally by the fifth step 30 of FIG. 2B. The person solving the puzzle will have one of two pieces of critical information: Either he/she will know the word to be uncovered, or will have a record of the chess moves required to uncover the word to be found. Where the word or phrase is known, the person solving the puzzle searches out each succeeding letter in the word or phrase on adjacent positions to the position of the chess piece being used. Where the movement of the chess piece is known, the solver advances the chess piece along the predetermined route, noting the letters over which the chess piece passes in order to find the word or phrase of the puzzle.

In the example of FIG. 2A, a bishop, which moves only diagonally, is used to solve the puzzle. The starting position is at f1, where the letter "S" is located. The next letter in the name is an "H," and only one "H" is located diagonally adjacent the f1 position, at position e2. Accordingly, the bishop is advanced from f1 to e2, as indicated by the first move path 202.

The next two letters of the name, "I" and "N", are noted as being located respectively at positions f3 and g4 of the board 200. However, the fourth letter "D" is not found along the same diagonal line. Accordingly, the bishop may be moved to position g4, as indicated by the second move path 204.

Movement continues as described above, with the puzzle solver searching out the next letter of the name in an adjacent diagonal position to the previously discovered letter. The fifth through seventh letters of the name, i. e., "D," "E," and "R," are located respectively at positions f5, e6, and d7 of the board 200, and the chess piece is advanced accordingly to d7, as indicated by the third movement path 206. Here again, the next letter does not fall along the same diagonal path as the third movement path 206, but rather turns to the left, with the eighth through tenth letters of the name ("O," "V," and "S") being located respectively at positions c6, b5, and a4 of the board 200. Finally, the last two letters ("K" and "Y") are located respectively at positions b3 and c2 of the board 200. The solver of the puzzle need only note each letter as the chess piece is advanced, to read the word or phrases of the final solution.

As noted above, the above puzzle may be solved even if the word is not known, if the movement of the chess piece is known. In the example of FIG. 2, if the solver of the puzzle is provided with the movement of the bishop, i. e., f1-e2-g4-d7-a4-c2, then he or she may also solve the puzzle, noting the letters of the word or phrase over which the chess piece passes while being moved in accordance with the above moves. It will be noted that these moves may cross over one another, and/or repeat certain letters (if a specific letter is used more than once in the word or phrase, e. g., the "S" in "SHINDEROVSKY"), depending upon the length of the word or phrase, the path of the chess piece, etc.

Figure 3A:
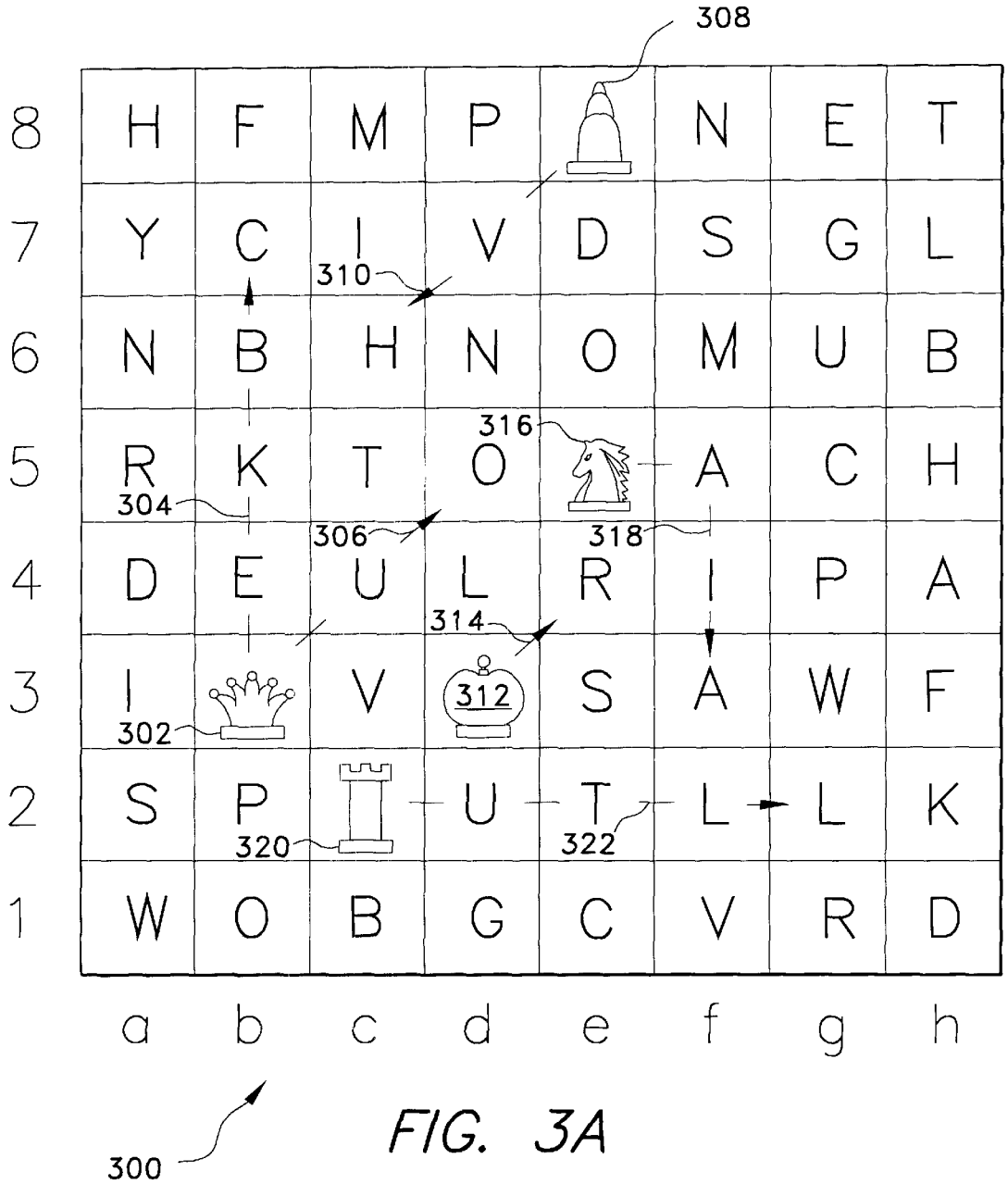
FIG. 3A shows an exemplary game board having a word and series of chess pieces placed thereon for solution according to the third embodiment of the present invention, and showing the solution to the problem.

FIG. 3A illustrates a further embodiment of the present alphabetic chess puzzles invention, wherein a word or short phrase is concealed in a straight line (rank, file, or diagonal) on the board and a plurality of chess pieces are used to uncover the word or phrase. As in the other embodiments described in detail further above, the initial step is to determine the word or phrase to be placed upon the board, as indicated by the first step 32 of FIG. 3B. The chess pieces to be used to find the object word, and their separate starting positions, are determined by working back from the end positions defined by the object word or phrase which has been placed on the board, as indicated generally by the second step 32 of FIG. 3B.

Figure 3B:
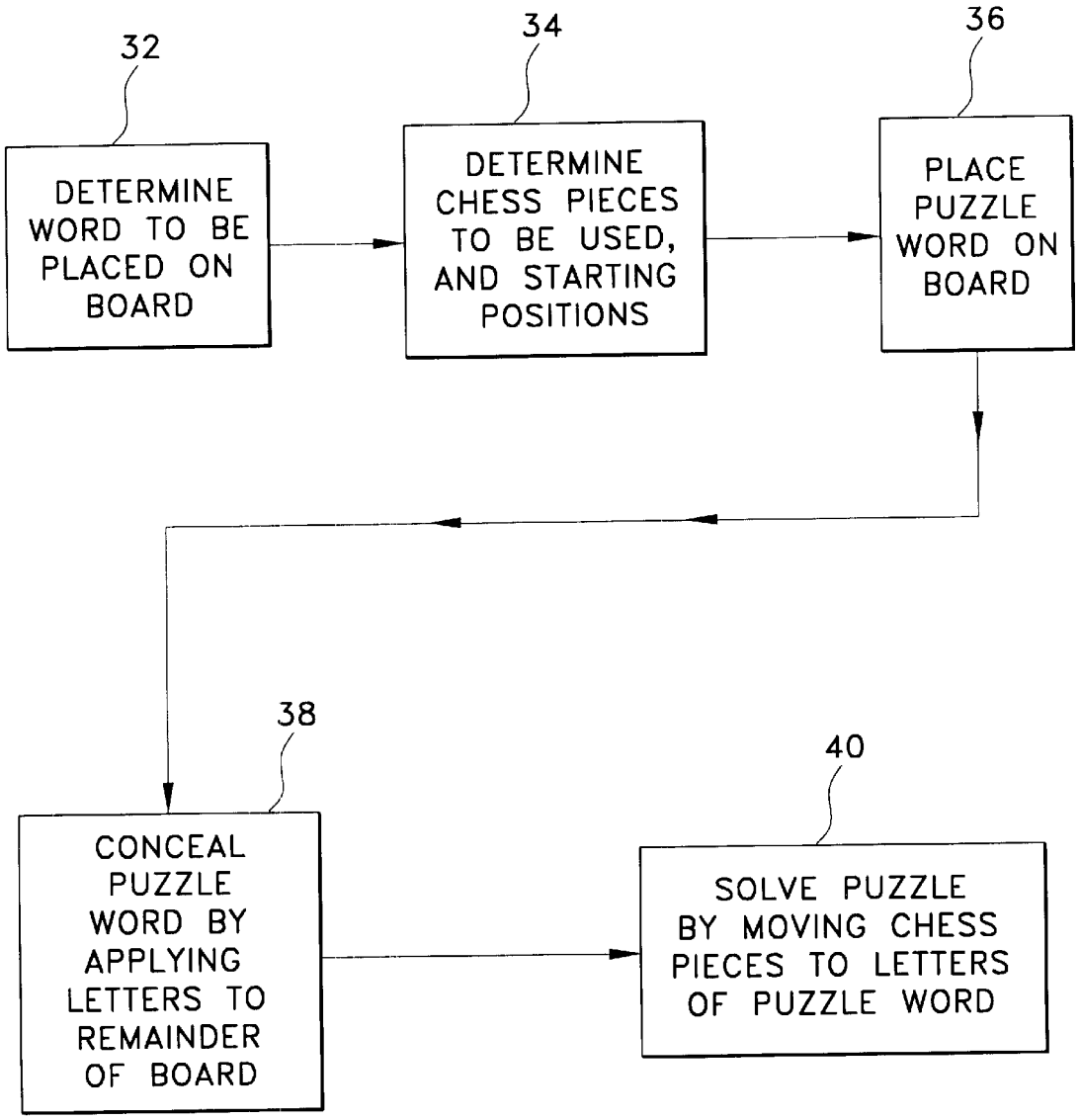
FIG. 3B is a flow chart describing the general procedure for forming and solving the word puzzle of FIG. 3A.

Preferably, the higher ranking chess pieces, i.e., king, queen, rook, bishop, and knight, are used for the puzzle embodiment of FIGS. 3A and 3B, as pawns are relatively restricted in their movement. However, under certain conditions where file or columnar advances of only one or two positions are needed, one or more pawns may be used in the puzzle embodiment of FIGS. 3A and 3B. The object word or phrase is placed upon the board essentially simultaneously with the placement of the chess pieces on the board, as indicated by the third step 36 of FIG. 3B. Finally, the puzzle word or phrase is concealed by placing additional letters on the remaining board positions, as indicated by the fourth step 38 of FIG. 3B. The result is a puzzle having an appearance exemplified by the board 300 of FIG. 3A. The puzzle, and perhaps the object word, are then provided to the person to solve the puzzle.

The puzzle of FIG. 3A is solved by advancing each of the chess pieces sequentially to the position called out in the given information for the puzzle. This will result in all of the chess pieces being aligned in a single line, after each piece is moved properly according to the puzzle instructions. In the example of FIG. 3A, the queen 302 located at position b3 is advanced to position b7, as indicated by the dashed movement line 304, and placed upon the letter "C" at that position. It will be noted that the queen 302 is actually moved from its original starting position twice, with a second move 306 from position b3 to position d5. The letter at position dcould be defined by another piece, but the rules of the embodiment of FIGS. 3A and 3B permit multiple moves by any or all of the pieces used, if so desired by the person forming the puzzle.

The bishop 308 positioned at e8 is then moved to position c6, as indicated by the movement line 310, and placed upon the "H" of position c6. Next, the queen 302 is moved again from its original starting position b3 diagonally upward and to the right to position d5, as described further above, where the letter "O" is located. The king 312 is then moved one position diagonally upward and to the right from its initial position d3 to position e4, as indicated by the movement path 314, where an "R" is located. The knight 316 is then moved in a generally "L" shaped pattern 318 according to the conventional rules of chess, from its initial position e5 to position f3, having an "A." Finally, the rook 320 is moved from position c2 to position g2, and the second letter "L" of that row.

The result of the above described moves is to position the chess pieces along a diagonal defined by positions b7, c6, d5, e4, f3, and g2, which positions respectively contain the letters "C," "H," "O," "R," "A," and "L," to spell the word "CHORAL." While the above described example is relatively simple, it will be seen that additional challenge may be provided by requiring one or more of the pieces to make two or more moves to the final position, and/or placing the object word along two or more horizontal, vertical, and/or diagonal lines. While it is preferred that the person solving the puzzle not be provided with the object word, this may be done in the event that the person solving the puzzle is a novice or for whatever reason has difficulty using the standard chess notation and moves utilized in the formation and solving of the puzzle.

FIGS. 4A through 4E illustrate yet another type of puzzle or problem which may be provided according to the present invention, wherein chess problems may be devised by means of one or more letter hierarchy tables. Such tables are exemplified in FIGS. 4F through 4I, and respectively designated as tables 400 through 406. Each of the tables 400 through 406 comprises an eight by eight matrix of sixty four positions, corresponding exactly with a conventional eight by eight chessboard. A supplemental row, respectively 408 through 414, is also provided at the top of each of the tables 400 through 406, for purposes explained further. below.

The letter hierarchy tables 400 through 406 are formed essentially from another table comprising the frequency of appearance of the first letters of words of the English language. This table is constructed according to the relative number of English words beginning with each of the letters of the alphabet. A reasonable approximation was obtained by counting the number of pages containing words beginning with each letter of the alphabet, from an authoritative source such as a widely recognized English dictionary. More precise rankings may be determined through various computer programs and other sources, but the precise number of words beginning with any specific letter of the alphabet is not critical; the important consideration for the construction of the present tables, is their relative ranking. A table showing thee number of pages of English words beginning with each letter of the alphabet, according to "The Cassel Compact Dictionary" (copyright 1998, London), appears immediately below:

TABLE III

ENGLISH WORD FREQUENCY BY FIRST LETTER

| LETTER | NUMBER OF PAGES |
|---|---|
| S | 154 |
| C | 124 |
| P | 109 |
| B | 76 |

TABLE III-continued

ENGLISH WORD FREQUENCY BY FIRST LETTER

| LETTER | NUMBER OF PAGES |
|---|---|
| A | 74 |
| T | 71 |
| D | 66 |
| R | 66 |
| F | 63 |
| M | 61 |
| H | 49 |
| L | 48 |
| E | 46 |
| G | 44 |
| I | 41 |
| W | 34 |
| O | 30 |
| N | 23 |
| V | 20 |
| U | 18 |
| K | 12 |
| J | 10 |
| Q | 7 |
| Y | 4 |
| Z | 3 |
| X | 1 |

As each of the letter hierarchy tables 400 through 406 respectively of FIGS. 4F through 4I contains sixty four positions (plus their respective supplemental rows 408 through 414), it will be seen that the letters are repeated within each hierarchy table. In the tables 400 and 402 of FIGS. 4F and 4G, the five least commonly used first letters (i. e., "J," "Q," "Y," "X," and "Z") are removed and placed in the supplemental rows, thereby leaving a remainder of twenty one letters. These letters are distributed over the sixty four positions of the board three times each, to fill sixty three of the sixty four positions. The sixty fourth position is filled by using the letter "Y" as a supplemental vowel.

The arrangement of the letters across the tables 400 and 402 is not random, as might appear at a cursory glance. Rather, these letters are arranged in order to average out their frequency of use as first letters of words, in each row, column, and the longest diagonals of the tables. This is accomplished by arranging the letters so the additive values of any row, column, or the longest diagonals are approximately equal to one another, according to the number of pages on which each letter appears as a first letter per Table III above. It will be seen that such a system cannot produce precisely equal values in each row, column, and longest diagonals, due to the relatively wide variation in the number of pages upon which each word appears in the dictionary. However, the present system works quite well for distributing the letters of the alphabet fairly over the hierarchy tables for use in forming chess puzzles from words formed from the hierarchy table letters.

It will also be noted that this system of letter distribution in the hierarchy tables, allows many different possible arrangements of the letters. This allows two different hierarchy tables to be formed for use in formulating chess problems, with a first table, e. g., table 400 of FIG. 4F, being used to determine the positions of a first series of chess pieces (e. g., white), and table 402 of FIG. 4G being used to determine the positions of a second series of chess pieces (e. g., black), with the two series of pieces comprising opposing sides for a chess game. The precise locations of the letters in each table is not critical. However, it is important that no two like letters be positioned at the same board or table position in the two tables, in order to avoid any chance that two opposing chess pieces might be assigned the same position in setting up the chess problem.

Figure 4A:
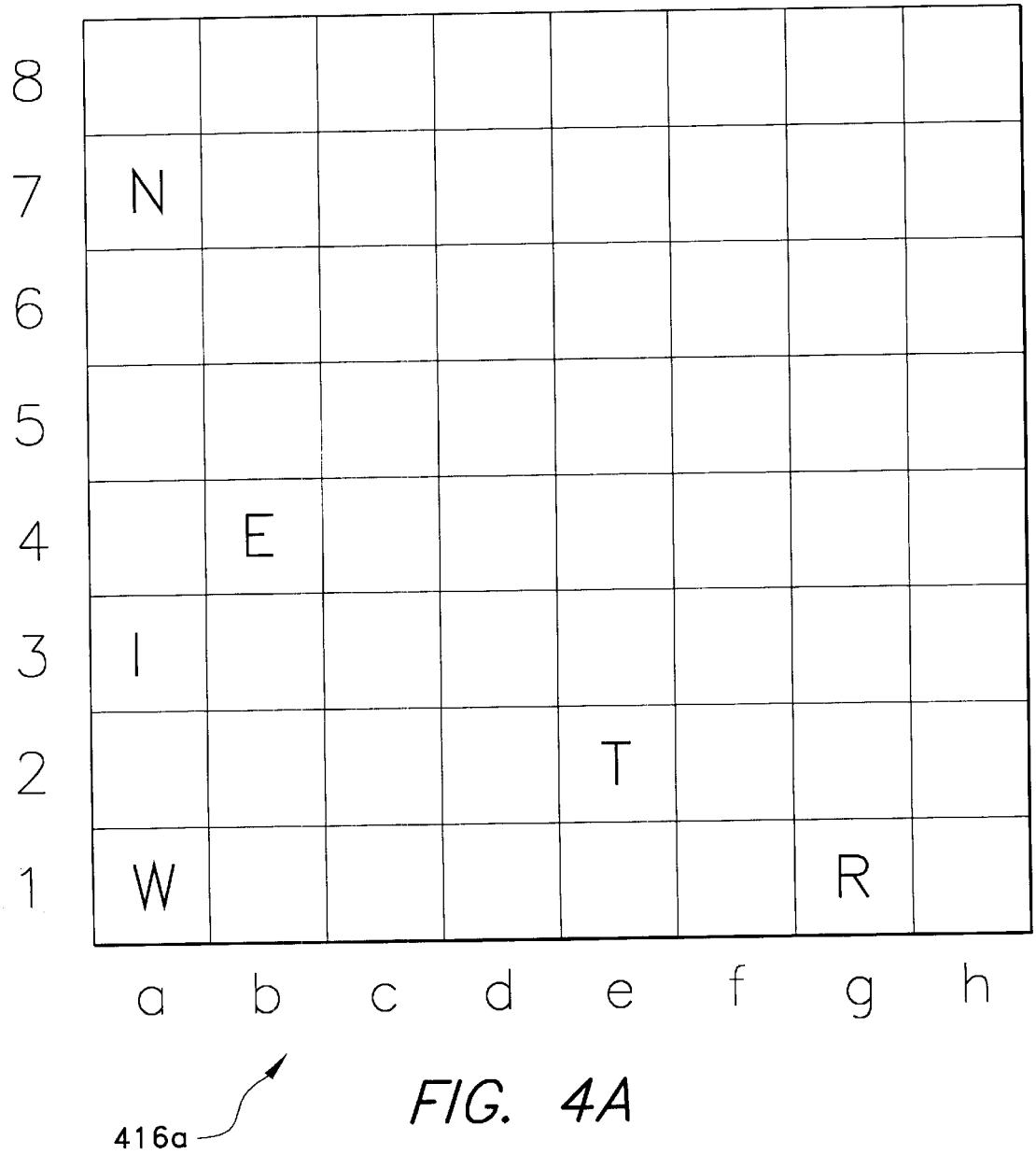
FIG. 4A shows a game board having the letters of a word placed thereon according a first table of letter hierarchy, to define the positions of a series of chess pieces on the board.
Figure 4B:
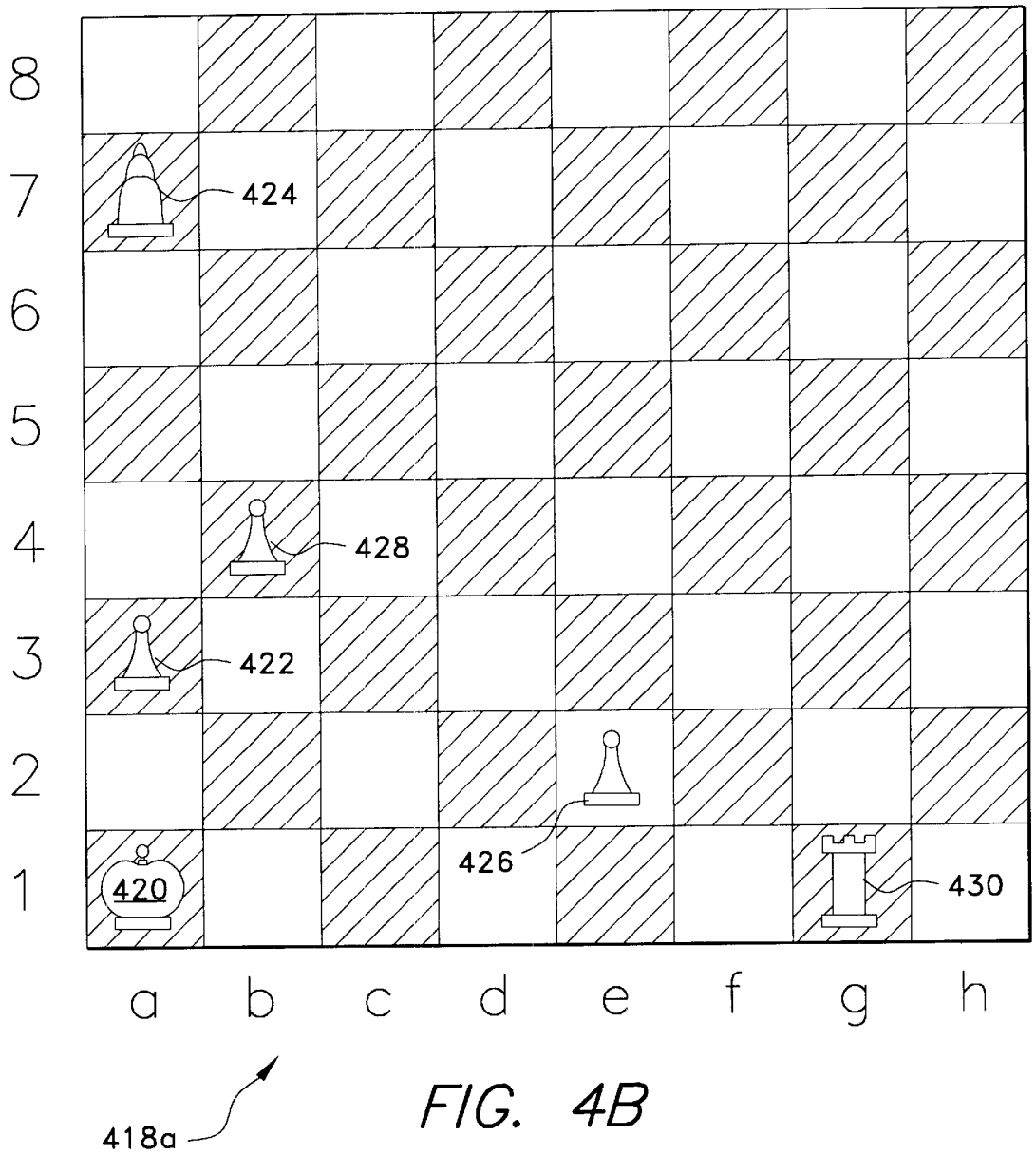
FIG. 4B shows a chessboard having a series of chess pieces placed thereon according to the letter arrangement of FIG. 4A.
Figure 4C:
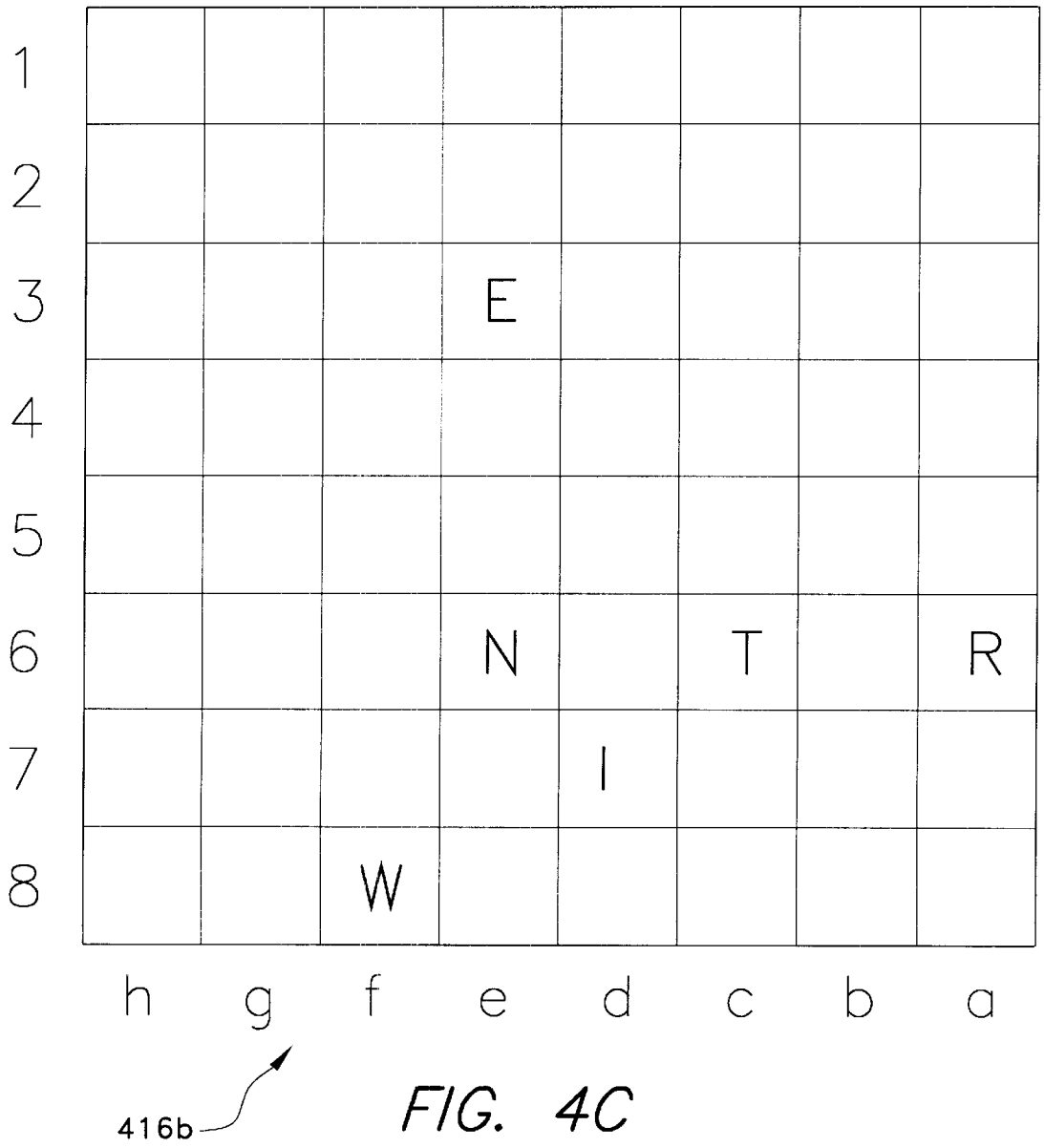
FIG. 4C shows a game board having the letters of the word of the board of FIG. 4A placed thereon, in accordance with a second predetermined table of letter hierarchy.
Figure 4D:
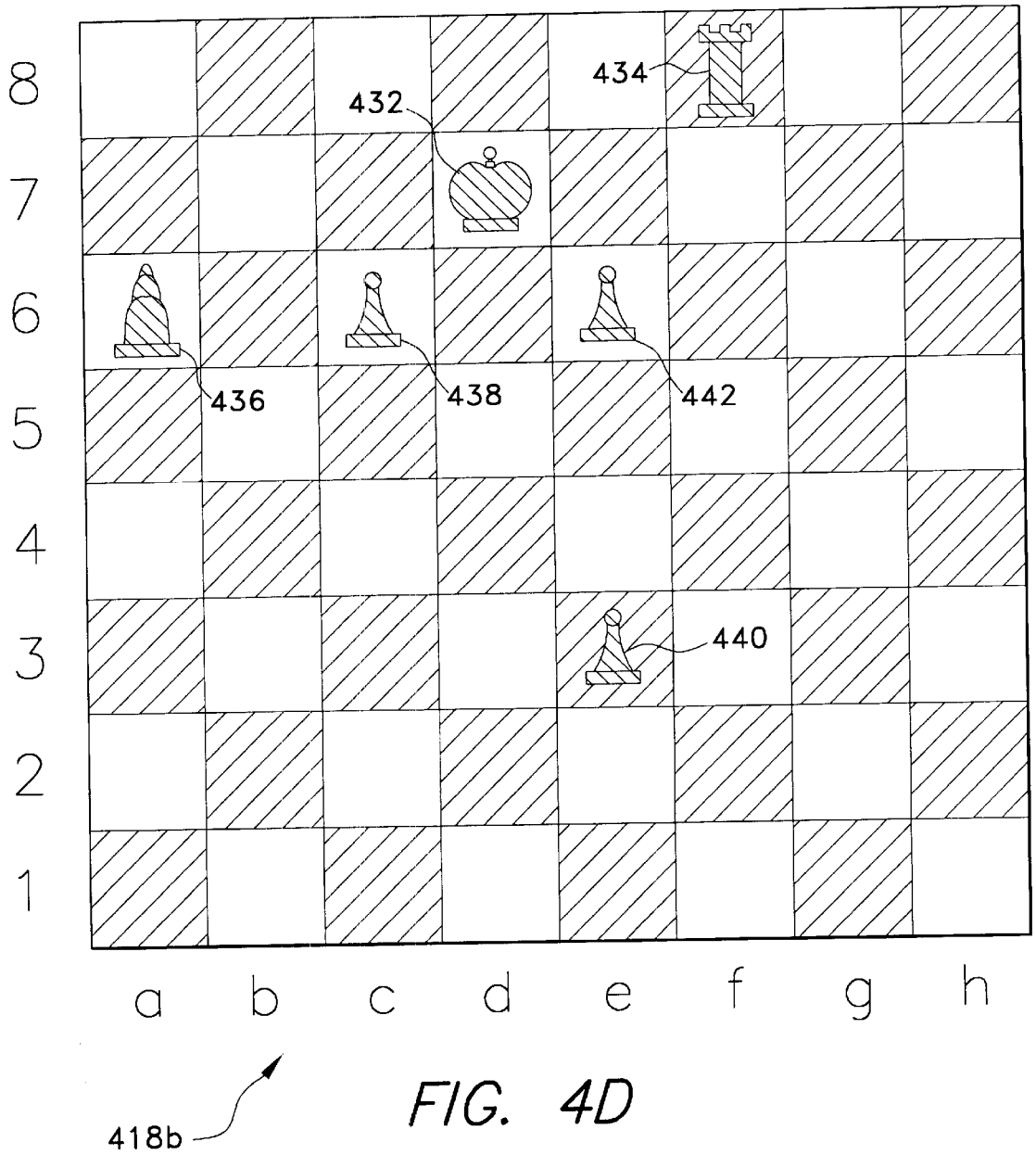
FIG. 4D shows a chessboard having a second series of chess pieces opposing the pieces of the board of FIG. 4B, placed in accordance with the arrangement of the letters of FIG. 4C.
Figure 4E:
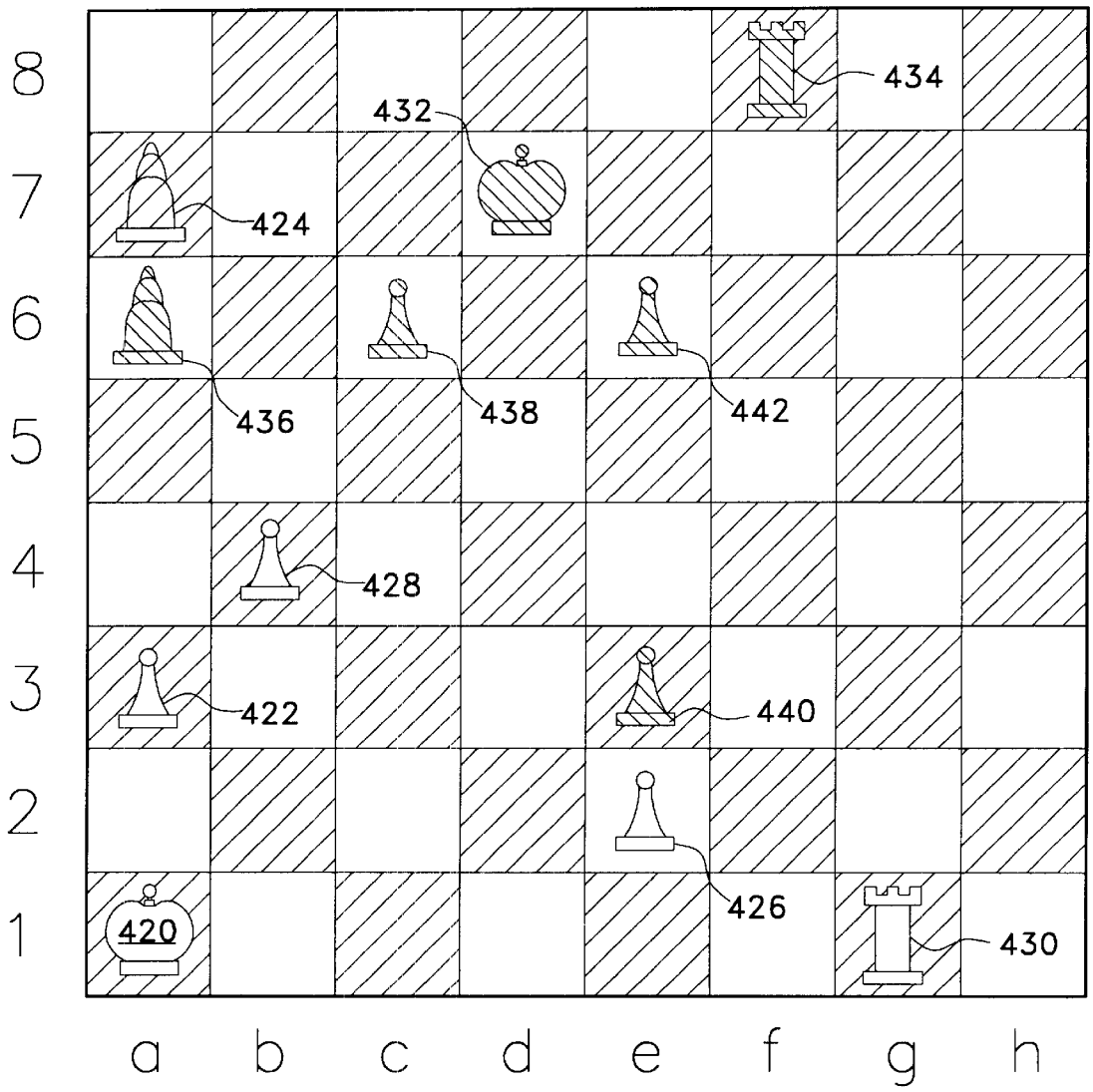
FIG. 4E shows a chessboard with all of the chess pieces of FIGS. 4B and 4D placed thereon, defining a chess problem.
Figure 4J:
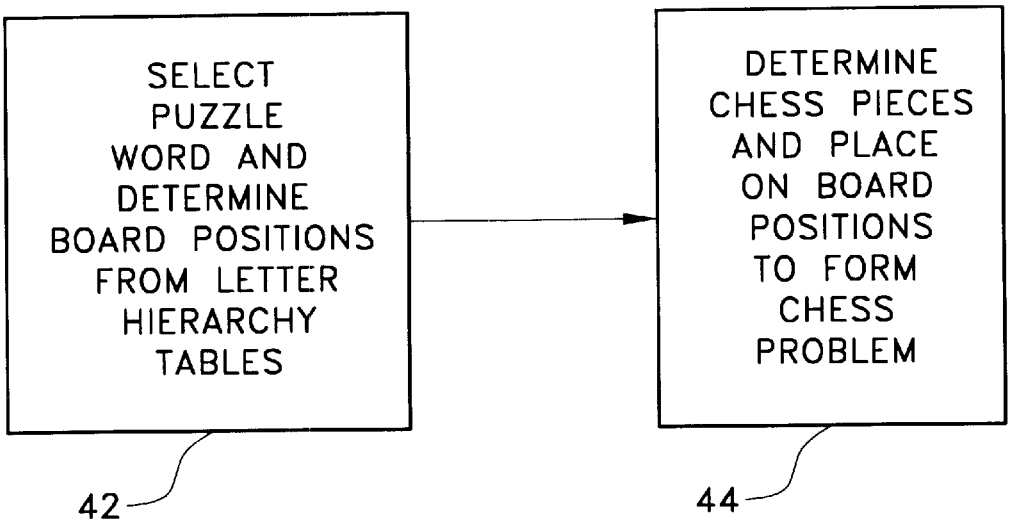
FIG. 4J is a flow chart describing the general process in developing a chess problem in accordance with the procedure and tables illustrated in FIGS. 4A through 4I.

At this point, a word is selected for use in forming the chess problem using the letter hierarchy tables 400 and 402, as indicated by the first step 42 of FIG. 4J. The word selected is arbitrary, and may be any practicable word desired. Preferably, the word is not excessively long, as each letter equates to a chess piece on the board. Obviously, no word or phrase may be more than sixteen letters long, as each side controls only sixteen chess pieces at the beginning of the game. Preferably, the word is on the order of four to eight letters long, thus providing a manageable number of chess pieces on the board and a challenging chess problem. It will be seen that the selected word may have up to three duplicate letters, due to the repetition of letters used in the letter tables.

As an example of the use of the letter hierarchy tables 400 and 402 of FIGS. 4F and 4G, the word "WINTER" has been selected for use in forming a chess problem according to the present invention. An examination of the first letter hierarchy table 400, for use in determining the positions of the first side (white) chess pieces, reveals that the letter "W" is located at positions a1, e8, and g3. (All letters of the eight by eight position area of the board are repeated three times, with the letter "Y" beings added as the sixty fourth letter, as explained further above.) The person forming the chess problem may use any one of these positions as desired. In this example, the first "W" located at position a1 is used, with that letter being placed in that position on the board 416*a* of FIG. 4A.

The positions of the subsequent letters of the word "WINTER" are determined in the same manner, with the "I" from position a3 of the first letter hierarchy table 400, the "N" from position a7 of that table, and the "T," "E," and "R" respectively from positions e2, b4, and g1 of the table 400 of FIG. 4F. These letters are placed in the corresponding positions of the board 416*a,* as shown in FIG. 4A and described in the first step 42 of FIG. 4J, to determine the locations of the first series of chess pieces to be used in forming the chess problem.

Once the locations have been determined, the chess pieces may be selected. This process may be based upon knowledge of the game in setting up a realistic problem, or may be determined by other means. For example, the chess pieces may be selected in order of rank or value in order of the letters of the word used in setting up the problem, with the king being placed upon the position of the first letter of the word, the next ranking piece (e. g., queen, or perhaps a rook, if the queen is not used) on the position of the second letter of the word, etc. Alternatively, the ranks of the chess pieces used in the problem may be coordinated with the ranking of the letters of the word used, with the "T" position being used for the king, the "R" position for the next highest chess piece, etc.

In the example of FIGS. 4A and 4B, the king 420 has been placed on position a1 of the board 418*a* of FIG. 4B, with a first pawn 422 at the "I" position a3, a bishop 424 at the "N" position a7, two more pawns 426 and 428 respectively located at the b4 and e2 positions, and finally, a rook 430 placed at the gl position of the board 418*a* of FIG. 4B. The placement of the chess pieces on the chessboard is described generally in the second step 44 of FIG. 4J of the drawings.

It will be seen that the positions of the chess pieces 420 through 430 on the chessboards 418*a* of FIG. 4B and 418 of FIG. 4E, correspond exactly with the positions of the letters on the layout board 416*a* of FIG. 4A, as developed from the first letter hierarchy table 400 of FIG. 4F. The placement of the various pieces 420 through 430 used for the first side of the problem have not been assigned according to any letter order or hierarchy in this example, but rather to develop a realistic position which would be a feasible end game position for one side.

The placement of the opposite side pieces is performed in much the same manner, with the second table 402 of FIG. 4G assuring different positions for the second side pieces, with one additional consideration being that neither king is permitted to be in check upon completion of the forming of the chess problem. However, it will be noted that the reference characters for the rows and columns of the second letter hierarchy table 402 of FIG. 4G, are reversed relative to the other chess and layout boards discussed to this point. This is because opponents are positioned to opposite sides of a chessboard. Thus, the positions of the chess pieces as determined using the letter hierarchy table 402 of FIG. 4G, should be inverted relative to the chessboard 418*b* upon which they are places, as shown in FIG. 4D. The second hierarchy table 402 of FIG. 4G automatically accomplishes this, as the letters of the word "WINTER" are transposed from the table 402, with its reversed row and column designators, to the chessboard 148*b* of FIG. 4D, with its row and column designators in normal order.

In the example of FIGS. 4C, 4G, and 4D, the letters of the word "WINTER" determining the chess piece positions are located respectively at positions f8, d7, e6, c6, e3, and a6 of the second letter hierarchy table 402 of FIG. 4G. These positions are transposed to the layout board 416*b* of FIG. 4C. As the row and column reference characters are reversed between the second letter hierarchy table 402 and the layout boards 416*a,* 416*b,* it will be noted that the resulting letter positions on the layout board 416*b* are "mirror imaged" from their positions on the hierarchy table 402.

It will be seen that the two boards 416*a* of FIG. 4A and 416*b* of FIG. 4C are identical to one another, excepting the positions of the letters thereon. The letter positions of the layout board 416*b,* for the second side (or black) pieces, are used to determine the positions of the second side or black chess pieces on the chess board 418*b* of FIG. 4D. Again, the ranks of the chess pieces used, and their relative locations on the positions as designated by the hierarchy table 402 of FIG. 4G, may be determined by the person setting up the chess problem, or according to the order or hierarchy of the letters used to determine the positions of the chess pieces, as described further above in the discussion of the arrangement of the first side (or white) chess pieces. In the case of the chessboard 418*b* of FIG. 4D, the king 432 has been placed at the "I" position at d7, the rook 434 at the "W" position f8, the bishop 436 at the "R" position a6, and the three pawns 438 through 442 respectively at the positions of the "N," "T," and "E," respectively at c6, e3, and e6 of the board 418*b*.

The finalized chessboard 418 of FIG. 4E illustrates the placement of the first side (white) chess pieces 420 through 430 from the board 418*a* of FIG. 4B and second side (black) pieces 432 through 442 from the board 418*b* of FIG. 4D, on the single board 418. This completes the formation of the chess problem, with the various chess pieces of the problem being balanced regarding number and ranking or power of the pieces. It will be seen that the present method of creating a chess problem may be modified, e. g. using different words for each side, etc., as desired.

As noted further above, a different letter hierarchy table was provided for each side of the chess problem described above. Those two tables 400 and 402, respectively of FIGS.

4F and 4G, are the result of the placement of the twenty one most commonly used first letters of words of the English language on a sixty four position table, with the five least commonly used letters being omitted from the sixty four position grid (with the exception of one letter, to fill in the sixty fourth position) and placed in a supplemental row at the top of the table. This arrangement allows the vast majority of English words to be used in the formation and development of chess problems according to the present inventive method, with words beginning with any of the five least commonly used first letters also being permitted by exchanging those letters as required with others on the table.

However, alternative embodiments of the hierarchy tables may be provided as illustrated by the tables 404 and 406, respectively of FIGS. 4H and 4I of the drawings. The alternative tables 404 and 406, representing first letter positions for determining the respective locations of opposite side (white and black) chess pieces, have the next least commonly used first letters (or more specifically, consonants, in order to retain the vowel "U" in the eight by eight lower matrix of positions) removed from the sixty four position matrices of the tables, and placed along their respective upper rows 412 and 414.

As the hierarchy tables 400 and 402 of FIGS. 4F and 4G had the first through fifth least commonly used letters (i. e., the twenty second through twenty sixth most commonly used first letters) removed from the sixty four position matrices of the tables and placed along their upper rows, the alternative tables 404 and 406 serve to complete their respective upper rows 412 and 414, with the sixth through eighth least commonly used first consonants (i. e., "K," "V," and "N," in that order) being removed from the sixty four position matrices of the two tables, and placed in their respective supplemental rows 412 and 414 to complete those rows. The otherwise blank positions where those removed letters once resided, are filled in with the three most commonly used first letters in the English language, i.e., "S," "C," and "P," respectively in those positions.

As many more English words begin with the letters "S," "C," and "P" than with the removed letters "K," "V," and "N," it will be seen that this opens the way for many more possible words to be used in the forming of chess problems according to the present invention. This still results in the average first letter frequency of use remaining approximately the same for each row, column, and major diagonal, as was achieved for the hierarchy tables 400 and 402 of FIGS. 4F and 4G and as is desirable.

In conclusion, the present alphabetic chess puzzle methods result in a novel combination of the classic game of chess and word problems and puzzles of various sorts. The present methods may be used to create puzzles on a chessboard, where multiple moves of a a1 single chess piece, or single moves of several chess pieces, are required on a board in order to uncover the concealed word or phrase of the puzzle. Another embodiment provides for the formation of chess problems, wherein a series of opposing chess pieces are placed upon a chess board in an exemplary end game position, with the object being to win the end game with one side or the other. The provision of the letter hierarchy tables of the present invention provides the basis for the development of such problems, from which the positions of the chess pieces may beg determined for placement on the chessboard.

While the above disclosure is primarily directed to a physical structure requiring manual manipulation of game pieces and components, it should be noted that the various embodiments of the present alphabetic chess puzzles and games invention readily lend themselves to electronic or computer play, with the development of suitable programming. One or more persons may work such a computer based puzzle or play such a computer based game as desired, depending upon the specific programming and provision for multiple player play or puzzle resolution.

While the alphabetic letter hierarchy tables disclosed herein are primarily directed to an arrangement or matrix of alphabetic letters for setting up and solving various chess problems, it will be seen that the various hierarchy tables are also adaptable for use in developing and solving various alphabetic codes, as well. The code developer or solver may select a specific hierarchy table and corresponding series of chess positions or moves in order to indicate certain coded words, or to discover those words from a coded hierarchy table and chess position or move series.

While the present disclosure uses the English language throughout, it will be seen that all of the various embodiments of the present invention are adaptable to any written language or alphabet, as desired. Accordingly, the present alphabetic chess puzzles invention will find widespread interest wherever the game of chess and other mental games and puzzles, such as word puzzles, are played and enjoyed.

It is to be understood that the present invention is not limited to the embodiments described above, but encompasses any and all embodiments within the scope of the following claims.

I claim:

1. A method of forming and solving an alphabetic chess puzzle, comprising the following steps:

(a) providing a board having an eight by eight matrix of sixty four positions thereon;

(b) further providing a series of chess pieces for placement and movement on the board according to the conventional rules of chess;

(c) forming a list of object words for placement on the board;

(d) selecting a single one of the chess pieces and determining a starting position on the board for the selected chess piece;

(e) placing at least one object word of the list of object words on the board, with each letter of the at least one object word being placed in a separate position of the board;

(f) providing the board with letters positioned thereon, chess piece, and starting position to a player; and (g) solving the puzzle by moving the single chess piece sequentially according to the conventional rules of chess to board positions where key letters have been removed from the at least one object word, and determining the letters to be placed at those positions to form the at least one object word of the puzzle.

2. The method of forming an alphabetic chess puzzle according to the method of claim 1, further including the step of selecting the plurality of chess pieces from the group of chess pieces consisting of the king, queen, rook, bishop, and knight.

3. The method of forming an alphabetic chess puzzle according to the method of claim 1, further including the step of providing a plurality of object words on the board.

4. The method of forming an alphabetic chess puzzle according to the method of claim 3, further including the step of removing key letters from the plurality of object words to complete the puzzle formation.

5. The method of forming an alphabetic chess puzzle according to the method of claim 1, further including the step of providing only a single object word on the board.

6. The method of forming an alphabetic chess puzzle according to the method of claim 5, further including the step of distributing the letters of the single object word in accordance with the path of a chess piece making a series of sequential moves.

7. The method of forming an alphabetic chess puzzle according to the method of claim 1, further including the step of concealing the at least one object word of the puzzle by applying additional letters to other positions of the board.

8. The method of forming an alphabetic chess puzzle according to the method of claim 1, further including the step of providing the at least one object word of the list of object words to the player.

9. The method of forming an alphabetic chess puzzle according to the method of claim 1, further including the step of placing at least one hindrance position on the board.

10. A method of forming and solving an alphabetic chess puzzle, comprising the following steps:

(a) providing a board having an eight by eight matrix of sixty four positions thereon;

(b) further providing a series of chess pieces for placement and movement on the board according to the conventional rules of chess;

(c) selecting a single object word for placement on the board;

(d) placing the object word on the board, with each letter of the object word being placed in a separate position of the board along a straight line;

(e) selecting a plurality of the chess pieces;

(f) determining a like plurality of starting positions on the board for the selected chess pieces, with the starting positions of the pieces being determined by subsequent movement of the pieces to the positions of the letters of the object word;

(g) concealing the at least one object word of the puzzle by applying additional letters to other positions of the board;

(h) providing the board with letters positioned thereon, chess pieces, and respective starting positions to a player; and (i) solving the puzzle by moving the plurality of chess pieces sequentially on the board according to the conventional rules of chess, to positions on the board defining the straight line where the letters of the object word are located to determine the object word of the puzzle.

11. The method of forming an alphabetic chess puzzle according to the method of claim 10, further including the step of providing the single object word to the player.

12. The method of forming an alphabetic chess puzzle according to the method of claim 10, further including the step of selecting the plurality of chess pieces from the group of chess pieces consisting of the king, queen, rook, bishop, and knight.

13. A method of forming a chess problem using an alphabetic system, comprising the following steps:

(a) providing a board having an eight by eight matrix of sixty four positions thereon;

(b) further providing a first and a second series of chess pieces comprising opposing first and second sides, for placement and movement on the board according to the conventional rules of chess;

(c) further providing at least one table of letter hierarchy, with the table containing at least one of each of the letters of the alphabet on an eight by eight matrix of sixty four positions and a supplemental row;

(d) selecting a word for placement on the board;

(e) locating the positions of the letters of the selected word on the at least one letter hierarchy table, and transposing those positions and letters to the board;

(f) placing the first series of chess pieces on the positions of the board as determined by the selected word and use of the at least one letter hierarchy table; and (g) determining the placement of the second series of chess pieces on the board by inverting the positions of the letters on the board for the first series of chess pieces.

14. The method of forming an alphabetic chess puzzle according to the method of claim 13, further including the step of providing at least one separate table of letter hierarchy for each of the series of chess pieces.

15. The method of forming an alphabetic chess puzzle according to the method of claim 13, further including the step of determining the hierarchy of the letters of the at least one letter hierarchy table according to the frequency of use of the first letters of words of the English language.

16. The method of forming an alphabetic chess puzzle according to the method of claim 15, further including the steps of:

(a) placing the twenty one most frequently used first letters on the at least one letter hierarchy table three times each to fill sixty three of the sixty four positions on the table;

(b) placing the five least frequently used first letters in the supplemental row of the table; and (c) additionally placing one of the five least used first letters in the single remaining position of the table.

17. The method of forming an alphabetic chess puzzle according to the method of claim 16, further including the steps of:

(a) arranging the sixty four positions of the table to form eight rows and eight columns;

(b) assigning each of the letters a value according to its frequency of use; and (c) distributing the letters of the table in each row and each column so that the total additive values of the letters in each row and each column are approximately equal.

18. The method of forming an alphabetic chess puzzle according to the method of claim 16, further including the steps of:

(a) removing the sixth through eighth least commonly used first letters from the sixty four positions of the table;

(b) placing those sixth through eighth least commonly used first letters in the supplemental row of the table; and (c) replacing the removed sixth through eighth least commonly used first letters of the sixty four positions of the table, with letters comprising the first through third most commonly used first letters.

19. The method of forming an alphabetic chess puzzle according to the method of claim 18, further including the steps of:

(a) arranging the sixty four positions of the table to form eight rows and eight columns;

(b) assigning each of the letters a value according to its frequency of use; and (c) distributing the letters of the table in each row and each column so that the total additive values of the letters in each row and each column are approximately equal.

* * * * *